US012006647B2

(12) United States Patent
Jones et al.

(10) Patent No.: US 12,006,647 B2
(45) Date of Patent: Jun. 11, 2024

(54) HIGH STIFFNESS RELOCATABLE TOWER

(71) Applicant: MultiSensor Scientific, Inc., Cambridge, MA (US)

(72) Inventors: Terrence K. Jones, Sharon, MA (US); Ethan Bushberg Skutt, Ithaca, NY (US); Shea Thomas Nelson, Somerville, MA (US)

(73) Assignee: MultiSensor Scientific, Inc., Cambridge, MA (US)

( * ) Notice: Subject to any disclaimer, the term of this patent is extended or adjusted under 35 U.S.C. 154(b) by 0 days.

(21) Appl. No.: 17/733,004

(22) Filed: Apr. 29, 2022

(65) Prior Publication Data

US 2023/0265636 A1 Aug. 24, 2023

Related U.S. Application Data

(60) Provisional application No. 63/313,173, filed on Feb. 23, 2022.

(51) Int. Cl.
*E02D 27/42* (2006.01)
*E04H 12/10* (2006.01)
(Continued)

(52) U.S. Cl.
CPC ..... *E02D 27/42* (2013.01); *E04H 12/20* (2013.01); *E04H 12/345* (2013.01); *E02D 2220/00* (2013.01); *E04H 12/10* (2013.01)

(58) Field of Classification Search
CPC ..... E02D 27/42; E02D 2220/00; E04H 12/20; E04H 12/345; E04H 12/10; E04H 12/18;
(Continued)

(56) References Cited

U.S. PATENT DOCUMENTS 2,846,760 A 8/1958 Rohn
2,875,865 A 3/1959 Rohn
(Continued)

FOREIGN PATENT DOCUMENTS

AU 2014265022 A1 10/2015
EP 2469643 A1 6/2012
(Continued)

OTHER PUBLICATIONS

ARE Telecom & Wind, Assembled Foundation System (150-130 AFS) Installation Manual Telecom-Small Wind (Above Grade), 9 pages, (2018).
(Continued)

*Primary Examiner* — Gisele D Ford
(74) *Attorney, Agent, or Firm* — Choate, Hall & Stewart LLP; Ronen Adato; William R. Haulbrook

(57) ABSTRACT

Presented herein are systems, methods, and apparatus related to relocatable tower technologies that facilitate on-site deployment and provide improved stiffness in order to minimize motion at a tower top in a manner that existing approaches, which focus on survivability, do not contemplate. In particular, relocatable tower technologies described herein can be deployed rapidly and at low cost, at outdoor sites, to, e.g., provide a vertical mast upon which equipment can be mounted. In certain embodiments, features of relocatable towers described herein allow the vertical mast to survive and remain rigid while being exposed to outdoor elements, such as wind gusts (e.g., up to 110 Mph). Advantages of relocatable tower technologies described herein are particularly well suited where (e.g., scanning based) imaging and/or detection equipment is mounted at a top of the tower, and/or where towers are deployed at sensitive sites such as hydrocarbon production, storage and processing facilities.

28 Claims, 27 Drawing Sheets

(51) Int. Cl.
*E04H 12/20* (2006.01)
*E04H 12/34* (2006.01)

(58) Field of Classification Search
CPC ... E04H 12/2238; F24S 2025/02; F24S 25/10; F03D 13/20; F03D 13/22
See application file for complete search history.

(56) References Cited

U.S. PATENT DOCUMENTS

| | | | | |
|---|---|---|---|---|
| 3,020,985 | A | 2/1962 | Turner | |
| 3,021,885 | A | 2/1962 | Rohn | |
| 3,119,471 | A | 1/1964 | Turner | |
| 3,122,819 | A | 3/1964 | Rohn | |
| 3,182,761 | A * | 5/1965 | Goodrum | E04H 12/10 52/116 |
| 3,247,516 | A | 4/1966 | Rohn et al. | |
| 3,856,639 | A | 12/1974 | Rohn et al. | |
| 4,185,288 | A * | 1/1980 | Dosch | H01Q 3/08 343/765 |
| 4,922,264 | A | 5/1990 | Fitzgerald et al. | |
| 5,281,816 | A | 1/1994 | Jacobson et al. | |
| D369,785 | S | 5/1996 | Cotee | |
| 5,531,419 | A * | 7/1996 | Gustafsson | E04H 12/187 343/882 |
| 5,829,724 | A | 11/1998 | Duncan | |
| 6,390,435 | B1 * | 5/2002 | Gustafsson | E04H 12/20 343/882 |
| 6,604,732 | B1 | 8/2003 | Brinker | |
| 6,690,472 | B2 | 2/2004 | Reichardt et al. | |
| 7,075,653 | B1 | 7/2006 | Rutherford | |
| 7,486,399 | B1 | 2/2009 | Reichardt et al. | |
| 8,960,615 | B1 | 2/2015 | Johnson et al. | |
| 9,328,861 | B2 | 5/2016 | Johnson et al. | |
| 9,428,877 | B2 | 8/2016 | Clifton | |
| 9,879,441 | B2 | 1/2018 | Clifton | |
| 10,634,122 | B1 | 4/2020 | Clifton et al. | |
| 11,053,923 | B2 | 7/2021 | Clifton et al. | |
| 11,131,110 | B1 * | 9/2021 | Sternowski | E04H 12/2238 |
| 2004/0006941 | A1 | 1/2004 | Brinker | |
| 2004/0231251 | A1 | 11/2004 | Ward | |
| 2006/0202122 | A1 | 9/2006 | Gunn et al. | |
| 2006/0203248 | A1 | 9/2006 | Reichardt et al. | |
| 2010/0231722 | A1 | 9/2010 | Hill, Jr. et al. | |
| 2012/0228442 | A1 * | 9/2012 | Clifton | F24S 25/10 248/163.1 |
| 2013/0327942 | A1 | 12/2013 | Silny | |
| 2015/0069239 | A1 | 3/2015 | Kester et al. | |
| 2015/0159802 | A1 | 6/2015 | Johnson et al. | |
| 2015/0308140 | A1 * | 10/2015 | Clifton | E02D 27/425 248/346.2 |
| 2015/0316473 | A1 | 11/2015 | Kester et al. | |
| 2015/0376857 | A1 | 12/2015 | Clifton | |
| 2016/0069743 | A1 | 3/2016 | McQuilkin et al. | |
| 2016/0131576 | A1 | 5/2016 | Cabib et al. | |
| 2016/0334538 | A1 | 11/2016 | Rieker et al. | |
| 2016/0345835 | A1 | 12/2016 | Darty | |
| 2016/0369520 | A1 | 12/2016 | Clifton | |
| 2017/0336281 | A1 | 11/2017 | Waxman et al. | |
| 2018/0045596 | A1 | 2/2018 | Prasad et al. | |
| 2018/0266944 | A1 | 9/2018 | Waxman et al. | |
| 2020/0256319 | A1 | 8/2020 | Clifton et al. | |

FOREIGN PATENT DOCUMENTS

| | | | |
|---|---|---|---|
| FR | 2964133 | A1 | 3/2012 |
| WO | WO-93/17208 | A1 | 9/1993 |
| WO | WO-2002/027297 | A1 | 4/2002 |
| WO | WO-2017/201194 | A1 | 11/2017 |
| WO | WO-2018/170438 | A1 | 9/2018 |
| WO | WO-2019/099096 | A1 | 5/2019 |
| WO | WO-2020/154619 | A2 | 7/2020 |
| WO | WO-2023/163904 | A1 | 8/2023 |

OTHER PUBLICATIONS

Rohn Products, Erection Profile 25G/110MPH 3-Second Gust/No Ice G, 17 pages, (2010).
Invitation to Pay Additional Fees for PCT/US2023/013312, filed Feb. 17, 2023, 12 pages, (mailed Jun. 5, 2023).
International Search Report for PCT/US2023/013312, filed Feb. 17, 2023, 7 pages, (dated Jul. 28, 2023).
Written Opinion for PCT/US2023/013312, filed Feb. 17, 2023, 11 pages, (dated Jul. 28, 2023).

* cited by examiner

HIGH STIFFNESS RELOCATABLE TOWER

CROSS REFERENCE TO RELATED APPLICATIONS

This application claims priority to and benefit of U.S. Provisional Application No. 63/313,173, filed Feb. 23, 2022, the content of which is incorporated herein in its entirety.

FIELD

This invention relates generally to methods, systems, and apparatus for providing relocatable towers.

BACKGROUND

A variety of applications and technologies—ranging from cellular and radio transmission to alternative energy installations to street lighting—utilize minimalist vertical tower structures that can be deployed at a variety of sites without necessarily resorting to e.g., construction of permanent structures. Although installing such structures does not necessarily involve a scale of construction on the level of, e.g., a new building, expensive and heavy equipment is still often required. For example, concrete foundations poured below ground may be required, or, where towers are connected to an above-ground ballasted frame, still require multi-ton hydraulic jacks to be raised.

Moreover, current tower designs are designed with survivability in mind, and are allowed to sway, e.g., in gusts of wind. For certain applications, where stability of sensitive equipment mounted at a tower top is paramount, approaches that minimize undesired motion are needed.

Accordingly, there exists a need for improved relocatable tower designs, that, among other things, facilitate rapid and inexpensive on-site deployment while also providing improved stiffness to minimize undesired motion.

SUMMARY

Presented herein are systems, methods, and apparatus related to relocatable tower technologies that facilitate deployment and provide improved stiffness in order to minimize motion at a tower top in a manner that existing approaches, which focus on survivability, do not contemplate. In particular, relocatable tower technologies described herein can be deployed rapidly and at low cost, at outdoor sites, e.g., to provide a vertical mast upon which equipment can be mounted. In certain embodiments, features of relocatable towers described herein allow the vertical mast to survive and remain rigid while being exposed to outdoor elements, such as wind gusts (e.g., up to 110 Mph). Advantages of relocatable tower technologies described herein are particularly well suited where (e.g., scanning based) imaging and/or detection equipment is mounted at a top of the tower, and/or where towers are deployed at sensitive sites such as hydrocarbon storage and processing facilities.

In certain applications, such as for example detection of methane emissions at upstream oil and gas sites, there is a need to erect a tower for a short period of time (days, weeks, or months), for example in order to monitor a site for intermittent emissions or to validate the success of a repair, and to then be able to relocate the tower and the camera to another site.

Accordingly, described herein are tower systems comprising, among other things, a tower base that renders it easy to assemble, relocate, and raise a substantial tower without necessarily requiring use of ground penetration and/or heavy machinery such as cranes, forklifts, scissor lifts, and the like at the time of tower erection [e.g., any type of powered equipment that is not portable (e.g., cannot be carried by one person)]. In certain embodiments, even where certain machinery may be required to deliver ballast weight (e.g., if large precast concrete blocks are used), as described in further detail herein, such weight can be delivered to a site independently from the tower base and mast, allowing, for example, for a truck to pre-deliver and place ballast weight at multiple sites. Tower components (e.g., base and vertical mast) can then be brought to the site, mounted to pre-existing ballast, and deployed, by a small number of individuals (e.g., two) without use of heavy machinery.

In certain embodiments, tower bases as described herein create a tower system that is very stiff when compared to other structures, for example un-stayed monopole structures. As described herein, enhanced stability is important in imaging applications where oscillations during image collection result in loss of resolution and/or, for example, in the case of gas cloud imaging, a loss of sensitivity.

In certain embodiments, tower systems described herein comprise a base plate that supports a vertical mast (e.g., to be raised) and legs (also referred to as extension beams) that couple to ballast elements that provide support and stability under high wind loads. As described in further detail herein, systems and apparatus of the present disclosure include ballast adaptors that allow for tower systems to be agnostic with respect to particular types of ballast weight used. For example, in certain embodiments, a variety of ballast weight types, such as concrete bricks, poured (e.g., cast) concrete blocks, jersey barriers, etc. can be used in a flexible fashion, by virtue of ballast adaptors that allow a tower base to be secured to any type of ballast and provide stability in a manner that allows the most economical ballast to be supplied to the site to be used.

Moreover, in certain embodiments, ballast adaptors provide for a degree of tolerance in terms of the exact locations where ballast weights are positioned. As a result, ballast adaptors described herein facilitate deployment of tower systems, avoiding a need for ballast weight to be delivered with and/or added to an existing tower structure, allowing for e.g., heavy ballast weight to be pre-delivered to a site, and a tower to be deployed subsequently.

In certain embodiments, tower bases as described herein comprise multiple adjustable hinged couplings that act as supports for a vertical mast. Once raised, a vertical mast sits on top of, and can be supported by surfaces of the hinged couplings such that, together, surfaces of the hinged couplings provide a stable base for the vertical mast. Approaches described herein utilize, in certain embodiments, multiple couplings, whose heights can be adjusted independently, allowing the plane on which the base of the vertical mast sits to be effectively tilted and leveled, in order to account for e.g., uneven or sloping ground. Moreover, approaches described herein allow this leveling may be carried out prior to raising the vertical mast, further facilitating deployment.

Accordingly, tower systems and apparatus described herein provide systems that can be rapidly deployed to raise a rigid vertical mast that can accommodate, among other things, motion-sensitive imaging applications.

In one aspect, the invention is directed to a relocatable and ballast-agnostic tower base for providing a foundation to raise and support a rigid vertical mast, the tower base comprising: a base plate for connecting to the vertical mast; a plurality of legs, each leg connected to and extending outward (e.g., each of the legs lying in a common plane) from the base plate, toward a corresponding ballast location; and a plurality of ballast adaptors, each particular ballast adaptor of the plurality of ballast adaptors (i) associated with and connected to a particular leg at the corresponding ballast location and (ii) securable to a ballast weight [e.g., each ballast adaptor connectable (e.g., via adjustable screws) to a tray holding concrete blocks; e.g., each ballast adaptor comprising a hook (e.g., a J-hook) for connecting to a hook embedded in a pre-cast ballast (e.g., concrete) block].

In certain embodiments, the base plate is shaped to engage the vertical mast, wherein the vertical mast has a polygonal (e.g., triangular) cross section [e.g., the base plate having has a matching, polygonal (e.g., triangular) shape] (e.g., wherein a shape of the base plate is matched to a triangular cross section of a Rohn tower section).

In certain embodiments, the tower base comprises three or more legs [e.g., comprising three legs (e.g., the legs extending outwards in a triangular geometry)].

In certain embodiments, each of one or more (e.g., up to all) of the plurality of legs connects to the base plate in a rotatable fashion [e.g., each leg connecting to the base plate via a single connection point (e.g., bolt) about which the leg may rotate in a horizontal plane)] (e.g., allowing the base plate and legs connected thereto to be folded for storage and/or transport).

In certain embodiments, each particular ballast adaptor of the plurality of ballast adaptors is securable to a top (e.g., surface) of the ballast weight.

In certain embodiments, each of the plurality of ballast adaptors orients the particular leg to which it is connected above the ballast weight.

In certain embodiments, each particular ballast adaptor of the plurality of ballast adaptors comprises: a ballast rail connectable to ballast weight; a ballast mount; and a leg mount, wherein: the ballast mount is secured (e.g., bolted) to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail (e.g., along with any ballast weight connected thereto) of the particular ballast adaptor to the particular leg with which it is associated, with the ballast rail aligned along the first axis and the particular leg aligned along the second axis.

In certain embodiments, the first axis is substantially perpendicular to the second axis.

In certain embodiments, the ballast mount is situated below the leg mount, such that the particular leg is located above the ballast rail.

In certain embodiments, a cross section of the first passage of the ballast mount is sufficiently sized (e.g., larger than, by at least a pre-determined tolerance, a cross section of the ballast rail) to allow the ballast mount (e.g., with the leg mount secured thereto) to be translated along at least a portion of a length of the ballast rail; and a cross section of the second passage of the leg mount is sufficiently sized (e.g., larger than, by at least a pre-determined tolerance, a cross section of the leg) to allow the leg mount (e.g., with the ballast mount secured thereto) to be translated along at least a portion of a length of the leg [e.g., thereby providing for two degrees of freedom of movement (e.g., along the first and the second axis) within a plane in which the legs of the tower base lie].

In certain embodiments, the ballast mount comprises two or more U-hooks and is secured to (e.g., bolted to) the leg mount by connecting (e.g., via threaded connections) the two or more U-hooks with a lower surface of the leg mount.

In certain embodiments, the leg mount comprises two guides aligned and maintained with respect to each other in a spaced relationship [e.g., a particular (e.g., predetermined) distance apart (e.g., 6 inches or more apart; e.g., 1 foot or more apart)].

In certain embodiments, the tower base comprises: a kingpost affixed to an underside of the plurality of legs at a central point and extending downward; and for each particular leg, a corresponding kingpost stay (e.g., a chain, high tension wire, etc.) connecting (i) the particular leg and/or associated ballast adaptor at the corresponding ballast location to (ii) a substantially common central point at an apex of the kingpost.

In certain embodiments, for each particular leg, the corresponding kingpost stay connects to the particular leg and/or associated ballast adaptor at (e.g., an underside of) a guy wire connection point (e.g., a location, such as a bolt, pin, opening, etc., where a guy wire may be attached) [e.g., such that each corresponding kingpost stay shares a common connection point with a guy wire (e.g., the kingpost stay connected to the particular a leg and/or associated ballast adaptor at a guy wire connection point, from a bottom and a guy wire may be attached from a top)].

In certain embodiments, the base plate comprises a plurality of adjustable couplings (e.g., solid posts with substantially flat upper surfaces acting as, e.g., feet to support vertical posts of the vertical mast), each particular adjustable coupling matched to a vertical post of the vertical mast and comprising an upper surface for supporting (e.g., but not necessarily making direct contact with) the vertical post to which it is matched [e.g., wherein one or more components (e.g., a hinged connector) are interposed between the upper surface of the particular adjustable coupling and the vertical mast].

In certain embodiments, heights of the plurality of adjustable couplings are independently adjustable (e.g., allowing for leveling of the vertical mast by adjusting heights of the adjustable couplings).

In certain embodiments, a subset (e.g., two) of the adjustable couplings comprise hinged connectors into which their matching vertical posts can be inserted, wherein hinged connectors are rotatable about a common axis such that a vertical mast connected to the subset of the adjustable couplings via the hinged connectors can be rotated from a substantially horizontal position to a vertical orientation (e.g., and bracketed to a rear adjustable coupling to be secured in place).

In certain embodiments, the tower base further comprises a gin pole and/or a hand winch (e.g., located at a distal end of one of the plurality of legs) for raising and/or lowering the vertical mast.

In another aspect, the invention is directed to a relocatable tower system comprising: a relocatable and ballast-agnostic tower base (e.g., the relocatable and ballast-agnostic tower base of any one of the aspects and embodiments described herein); and a vertical mast (e.g., mounted to the tower base, e.g., via a base plate) comprising a plurality of (e.g., three) vertical poles [e.g., the vertical poles spaced about a perimeter of a polygonal cross section (e.g., occupying vertices of the polygon)] and a plurality of braces (e.g., poles) connecting each pole with an adjacent pole (e.g., diagonally and/or horizontally) at a plurality of locations (e.g., thereby forming a truss).

In certain embodiments, the vertical mast does not have a solid outer wall (e.g., wherein at least 50% of an outer surface of the vertical mast is open) [e.g., wherein the vertical mast has an open frame, comprised of the plurality of vertical poles and braces].

In certain embodiments, the tower system comprises a plurality of ballast weights, each ballast weight located at a particular ballast location (e.g., on the ground) and secured to the tower base via a corresponding one of a plurality of legs, each of the plurality of legs connected to a central base plate to which the vertical mast is connected, and extending outwards to a corresponding ballast location (e.g., and secured to a ballast weight at the corresponding ballast location via a ballast adaptor).

In certain embodiments, the plurality of legs are aligned and oriented in a common plane, located above the ballast weights.

In certain embodiments, the tower system further comprises a plurality of guy wires, each guy wire connecting a particular location along the vertical mast to a particular one of the plurality of ballast weights (e.g., via an end of a corresponding leg and/or a ballast adaptor, secured to the particular ballast weight).

In certain embodiments, each guy wire is connected to a particular leg and/or associated ballast adaptor (e.g., from above) at a corresponding guy wire connection point (e.g., a location, such as a bolt, pin, opening, etc., where a guy wire may be attached) to which a kingpost stay (e.g., as described herein) is also connected (e.g., from below) [e.g., such that each kingpost stay shares a common connection point with a guy wire (e.g., the kingpost stay connected to the particular a leg and/or associated ballast adaptor at a guy wire connection point, from a bottom and a guy wire may be attached from a top)].

In certain embodiments, the tower base comprises: a base plate for connecting to the vertical mast; a plurality of legs, each leg connected to and extending outward (e.g., each of the legs lying in a common plane) from the base plate, toward a corresponding ballast location; and a plurality of ballast adaptors, each particular ballast adaptor of the plurality of ballast adaptors (i) associated with and connected to a particular leg at the corresponding ballast location and (ii) securable to a ballast weight (e.g., a corresponding ballast weight positioned at the corresponding ballast location) [e.g., each ballast adaptor connectable (e.g., via adjustable screws) to a tray holding concrete blocks; e.g., each ballast adaptor comprising a hook (e.g., a J-hook) for connecting to a hook embedded in a pre-cast ballast (e.g., concrete) block].

In certain embodiments, the base plate of the tower base is shaped to engage the vertical mast, wherein the vertical mast has a polygonal (e.g., triangular) cross section [e.g., the base plate having has a matching, polygonal (e.g., triangular) shape] (e.g., wherein a shape of the base plate is matched to a triangular cross section of a Rohn tower section).

In certain embodiments, the tower base comprises three or more legs [e.g., comprising three legs (e.g., the legs extending outwards in a triangular geometry)].

In certain embodiments, each of one or more (e.g., up to all) of the plurality of legs connects to the base plate in a rotatable fashion [e.g., each leg connecting to the base plate via a single connection point (e.g., bolt) about which the leg may rotate in a horizontal plane)] (e.g., allowing the base plate and legs connected thereto to be folded for storage and/or transport).

In certain embodiments, each particular ballast adaptor of the plurality of ballast adaptors is securable to a top (e.g., surface) of the ballast weight (e.g., the corresponding ballast weight positioned at the corresponding ballast location).

In certain embodiments, each of the plurality of ballast adaptors orients the particular leg to which it is connected above the ballast weight (e.g., the corresponding ballast weight positioned at the corresponding ballast location).

In certain embodiments, the tower system comprises a plurality of ballast weights, and each particular ballast adaptor of the plurality of ballast adaptors is secured to a top (e.g., surface) of a corresponding one of the plurality of ballast weights positioned at the ballast location corresponding to the leg to which the particular ballast adaptor is connected (e.g., wherein each particular ballast adaptors orients the particular leg to which it is connected above the ballast weight positioned at the corresponding ballast location).

In certain embodiments, each particular ballast adaptor of the plurality of ballast adaptors comprises: a ballast rail connectable to ballast weight; a ballast mount; and a leg mount, wherein: the ballast mount is secured (e.g., bolted) to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail (e.g., along with any ballast weight connected thereto) of the particular ballast adaptor to the particular leg with which it is associated, with the ballast rail aligned along the first axis and the particular leg aligned along the second axis.

In certain embodiments, the first axis is substantially perpendicular to the second axis.

In certain embodiments, the ballast mount is situated below the leg mount, such that the particular leg is located above the ballast rail.

In certain embodiments, a cross section of the first passage of the ballast mount is sufficiently sized (e.g., larger than, by at least a pre-determined tolerance, a cross section of the ballast rail) to allow the ballast mount (e.g., with the leg mount secured thereto) to be translated along at least a portion of a length of the ballast rail; and a cross section of the second passage of the leg mount is sufficiently sized (e.g., larger than, by at least a pre-determined tolerance, a cross section of the leg) to allow the leg mount (e.g., with the ballast mount secured thereto) to be translated along at least a portion of a length of the leg [e.g., thereby providing for two degrees of freedom of movement (e.g., along the first and the second axis) within a plane in which the legs of the tower base lie].

In certain embodiments, the ballast mount comprises two or more U-hooks and is secured to (e.g., bolted to) the leg mount by connecting (e.g., via threaded connections) the two or more U-hooks with a lower surface of the leg mount.

In certain embodiments, the leg mount comprises two guides aligned and maintained with respect to each other in a spaced relationship [e.g., a particular (e.g., predetermined) distance apart (e.g., 6 inches or more apart; e.g., 1 foot or more apart)].

In certain embodiments, the tower base comprises: a kingpost affixed to an underside of the plurality of legs at a central point and extending downward; and for each particular leg, a corresponding kingpost stay (e.g., a chain, high tension wire, etc.) connecting (i) the particular leg and/or associated ballast adaptor at the corresponding ballast location to (ii) a substantially common central point at an apex of the kingpost.

In certain embodiments, for each particular leg, the corresponding kingpost stay connects to the particular leg and/or associated ballast adaptor at (e.g., an underside of) a guy wire connection point (e.g., a location, such as a bolt, pin, opening, etc., where a guy wire may be attached) [e.g., such that each corresponding kingpost stay shares a common connection point with a guy wire (e.g., the kingpost stay connected to the particular a leg and/or associated ballast adaptor at a guy wire connection point, from a bottom and a guy wire may be attached from a top)].

In certain embodiments, the tower base comprises (e.g., situated above and about a perimeter of a central base plate) a plurality of adjustable couplings (e.g., solid posts with substantially flat upper surfaces acting as, e.g., feet, to support vertical posts of the vertical mast), each particular adjustable coupling matched to a vertical post of the vertical mast and comprising an upper surface for supporting (e.g., but not necessarily making direct contact with) the vertical post to which it is matched [e.g., wherein one or more components (e.g., a hinged connector) are interposed between the upper surface of the particular adjustable coupling and the vertical mast].

In certain embodiments, heights of the plurality of adjustable couplings are independently adjustable (e.g., allowing for leveling of the vertical mast by adjusting heights of the adjustable couplings).

In certain embodiments, a subset (e.g., two) of the adjustable couplings comprise hinged connectors into which their matching vertical posts can be inserted, wherein hinged connectors are rotatable about a common axis such that a vertical mast connected to the subset of the adjustable couplings via the hinged connectors can be rotated from a substantially horizontal position to a vertical orientation (e.g., and bracketed to a rear adjustable coupling to be secured in place).

In certain embodiments, the tower system further comprises a gin pole (e.g., affixed to the vertical mast) and/or a hand winch (e.g., located at a distal end of one of the plurality of legs) for raising and/or lowering the vertical mast.

In certain embodiments, the tower system comprises an imaging sensor [e.g., an infrared (e.g., SWIR) imaging sensor; e.g., a scanning imaging sensor] mounted at a top of the vertical mast.

In another aspect, the invention is directed to a method of deploying a tower system comprising a rigid vertical mast and a tower base comprising a plurality of legs (e.g., securable to ballast), the method comprising: securing a tower base to a plurality of pre-existing ballast weights, each of the pre-existing ballast weights located (e.g., placed on the ground) at a particular ballast location, by: connecting, for each particular ballast location, a first end of a corresponding one of the plurality of legs of the tower base to a top of the pre-existing ballast weight via an associated ballast adaptor; and connecting (e.g., a second end of) each of the legs to a common base plate of the tower base at a substantially central location with respect to the ballast locations.

In certain embodiments, for each particular pre-existing ballast weight located at the particular ballast location, the associated ballast adaptor is (i) connected to the first end of the corresponding leg and (ii) securable to the particular pre-existing ballast weight [e.g., each ballast adaptor connectable (e.g., via adjustable screws) to a tray holding concrete blocks; e.g., each ballast adaptor comprising a hook (e.g., a J-hook) for connecting to a hook embedded in a pre-cast ballast (e.g., concrete) block].

In certain embodiments, the base plate is shaped to engage the vertical mast, wherein the vertical mast has a polygonal (e.g., triangular) cross section [e.g., the base plate having has a matching, polygonal (e.g., triangular) shape] (e.g., wherein a shape of the base plate is matched to a triangular cross section of a Rohn tower section).

In certain embodiments, the tower base comprises three or more legs [e.g., comprising three legs (e.g., the legs extending outwards in a triangular geometry)].

In certain embodiments, each of one or more (e.g., up to all) of the plurality of legs connects to the base plate in a rotatable fashion [e.g., each leg connecting to the base plate via a single connection point (e.g., bolt) about which the leg may rotate in a horizontal plane)] (e.g., allowing the base plate and legs connected thereto to be folded for storage and/or transport).

In certain embodiments, each ballast adaptor is securable to a top (e.g., surface) of the pre-existing ballast weight with which it is associated.

In certain embodiments, each ballast adaptor orients the particular leg to which it is connected above the pre-existing ballast weight.

In certain embodiments, each ballast adaptor comprises: a ballast rail connectable to ballast weight; a ballast mount; and a leg mount, wherein: the ballast mount is secured (e.g., bolted) to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail (e.g., along with any ballast weight connected thereto) of the particular ballast adaptor to the particular leg with which it is associated, with the ballast rail aligned along the first axis and the particular leg aligned along the second axis.

In certain embodiments, the first axis is substantially perpendicular to the second axis.

In certain embodiments, the ballast mount is situated below the leg mount, such that the particular leg is located above the ballast rail.

In certain embodiments, a cross section of the first passage of the ballast mount is sufficiently sized (e.g., larger than, by at least a pre-determined tolerance, a cross section of the ballast rail) to allow the ballast mount (e.g., with the leg mount secured thereto) to be translated along at least a portion of a length of the ballast rail; and a cross section of the second passage of the leg mount is sufficiently sized (e.g., larger than, by at least a pre-determined tolerance, a cross section of the leg) to allow the leg mount (e.g., with the ballast mount secured thereto) to be translated along at least a portion of a length of the leg [e.g., thereby providing for two degrees of freedom of movement (e.g., along the first and the second axis) within a plane in which the legs of the tower base lie].

In certain embodiments, the ballast mount comprises two or more U-hooks and is secured to (e.g., bolted to) the leg mount by connecting (e.g., via threaded connections) the two or more U-hooks with a lower surface of the leg mount.

In certain embodiments, the leg mount comprises two guides aligned and maintained with respect to each other in a spaced relationship [e.g., a particular (e.g., predetermined) distance apart (e.g., 6 inches or more apart; e.g., 1 foot or more apart)].

In certain embodiments, the tower base comprises a kingpost affixed to an underside of the plurality of legs at a central point and extending downward, and the method comprises connecting, for each particular leg of the plurality of legs, a corresponding kingpost stay (e.g., a chain, high tension wire, etc.) from (i) a substantially distal end of the particular leg and/or the associated ballast adaptor, located at the corresponding ballast location to (ii) a substantially common central point at an apex of the kingpost.

In certain embodiments, for each particular leg, the corresponding kingpost stay connects to the particular leg and/or associated ballast adaptor at (e.g., an underside of) a guy wire connection point (e.g., a location, such as a bolt, pin, opening, etc., where a guy wire may be attached) [e.g., such that each corresponding kingpost stay shares a common connection point with a guy wire (e.g., the kingpost stay connected to the particular a leg and/or associated ballast adaptor at a guy wire connection point, from a bottom and a guy wire may be attached from a top)][e.g., and wherein the method comprises (e.g., for each particular leg) connecting a guy wire from a location along the vertical mast to the guy wire connection point].

In certain embodiments, the base plate comprises a plurality of adjustable couplings (e.g., solid posts with substantially flat upper surfaces acting as, e.g., feet, to support vertical posts of the vertical mast), each particular adjustable coupling matched to a vertical post of the vertical mast and comprising an upper surface for supporting (e.g., but not necessarily making direct contact with) the vertical post to which it is matched [e.g., wherein one or more components (e.g., a hinged connector) are interposed between the upper surface of the particular adjustable coupling and the vertical mast].

In certain embodiments, heights of the plurality of adjustable couplings are independently adjustable (e.g., allowing for leveling of the vertical mast by adjusting heights of the adjustable couplings) [e.g., and wherein the method comprises adjusting heights of one or more of the adjustable couplings].

In certain embodiments, a subset (e.g., two) of the adjustable couplings comprise hinged connectors into which their matching vertical posts can be inserted, wherein hinged connectors are rotatable about a common axis such that a vertical mast connected to the subset of the adjustable couplings via the hinged connectors can be rotated from a substantially horizontal position to a vertical orientation (e.g., and bracketed to a rear adjustable coupling to be secured in place).

In certain embodiments, the tower base comprises a gin pole (e.g., affixed to the vertical mast) and/or a hand winch (e.g., located at a distal end of one of the plurality of legs) for raising and/or lowering the vertical mast.

In certain embodiments, the method comprises mounting (e.g., and raising) the rigid vertical mast to the tower base.

In certain embodiments, the vertical mast does not have a solid outer wall (e.g., wherein at least 50% of an outer surface of the vertical mast is open) [e.g., wherein the vertical mast has an open frame, comprised of the plurality of vertical poles and braces].

In certain embodiments, the method comprises deploying the tower system without substantially penetrating a ground upon which the tower system (e.g., the tower base, the ballast weight(s), the vertical mast) is located.

In certain embodiments, the method comprises connecting a plurality of guy wires from locations along the vertical mast to locations above the pre-existing ballast weights, each guy wire connecting a particular location along the vertical mast to a particular one of the plurality of pre-existing ballast weights (e.g., via an end of a corresponding leg and/or a ballast adaptor, secured to the particular ballast weight).

In certain embodiments, each guy wire is connected to a particular leg and/or associated ballast adaptor (e.g., from above) at a corresponding guy wire connection point (e.g., a location, such as a bolt, pin, opening, etc., where a guy wire may be attached) to which a kingpost stay is also connected (e.g., from below) [e.g., such that each kingpost stay shares a common connection point with a guy wire (e.g., the kingpost stay connected to the particular a leg and/or associated ballast adaptor at a guy wire connection point, from a bottom and a guy wire may be attached from a top)].

In certain embodiments, none of: (i) the tower base, (ii) the plurality of ballast weights, and (iii) vertical mast are located at least in part beneath ground level (e.g., within a hole).

In certain embodiments, the method comprises deploying the tower system (e.g., not including the pre-exiting ballast weight) without using heavy machinery {e.g., cranes, fork-lifts, scissor lifts, and the like [e.g., any type of powered equipment that is not portable (e.g., cannot be carried by one person)]}.

In another aspect, the invention is directed to a method of re-deploying a tower system comprising a foldable base, the method comprising: (a) adjusting the foldable base to position a plurality of legs thereof in a folded orientation, wherein: the foldable base comprises the plurality of legs and a common base plate, each of the plurality of legs is connected to the common base plate at a corresponding connection point about the perimeter of the common base plate, each of at least a portion (e.g., up to all) of the plurality of legs is rotatable in a plane substantially parallel to the common base plate, about its corresponding connection point, and when in the folded orientation, each of the plurality of legs are aligned pointing in a substantially same direction (e.g., thereby minimizing a footprint of the foldable base); and (b) adjusting the foldable base to position the plurality of legs thereof in an un-folded orientation by rotating each of one or more of the plurality of legs about their corresponding common connection points, such that the plurality of legs point outwards (e.g., radially; e.g., at substantially equal angles with respect to each other) from the common base plate.

In certain embodiments, the method comprises securing the foldable tower base to a plurality of pre-existing ballast weights, each of the pre-existing ballast weights located (e.g., placed on the ground) at a particular ballast location by: following step (b), connecting, for each particular ballast location, a first end of a corresponding leg of the plurality of legs to a top of the pre-existing ballast weight via an associated ballast adaptor.

In certain embodiments, the method comprises, following step (a), storing and/or transporting the foldable tower base with the plurality of legs positioned in the folded orientation.

Features of embodiments described with respect to one aspect of the invention may be applied with respect to another aspect of the invention.

BRIEF DESCRIPTION OF THE DRAWING

The foregoing and other objects, aspects, features, and advantages of the present disclosure will become more apparent and better understood by referring to the following description taken in conjunction with the accompanying drawing, in which.

Figure 1C:
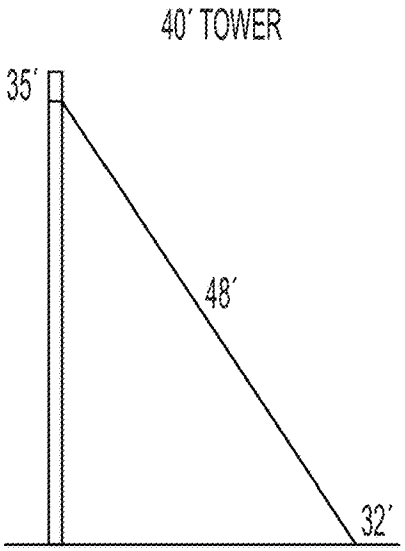
FIG. 1C is a schematic showing a tower with guy wires connected out at a low angle, creating a large area footprint.

The features and advantages of the present disclosure will become more apparent from the detailed description set forth below when taken in conjunction with the drawing.

DETAILED DESCRIPTION

It is contemplated that systems, architectures, devices, methods, and processes of the claimed invention encompass variations and adaptations developed using information from the embodiments described herein. Adaptation and/or modification of the systems, architectures, devices, methods, and processes described herein may be performed, as contemplated by this description.

Throughout the description, where articles, devices, systems, and architectures are described as having, including, or comprising specific components, or where processes and methods are described as having, including, or comprising specific steps, it is contemplated that, additionally, there are articles, devices, systems, and architectures of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

Documents are incorporated herein by reference as noted. Where there is any discrepancy in the meaning of a particular term, the meaning provided in the definitions in the present specification is controlling.

Headers are provided for the convenience of the reader—the presence and/or placement of a header is not intended to limit the scope of the subject matter described herein.

Described herein is a relocatable tower technology that addresses shortcomings of conventional tower designs. Among other things, tower designs of the present disclosure avoid any need for ground penetration, facilitate rapid on-site deployment without need for heavy equipment, and provide high stiffness while maintaining a relatively small footprint.

Figure 1B:
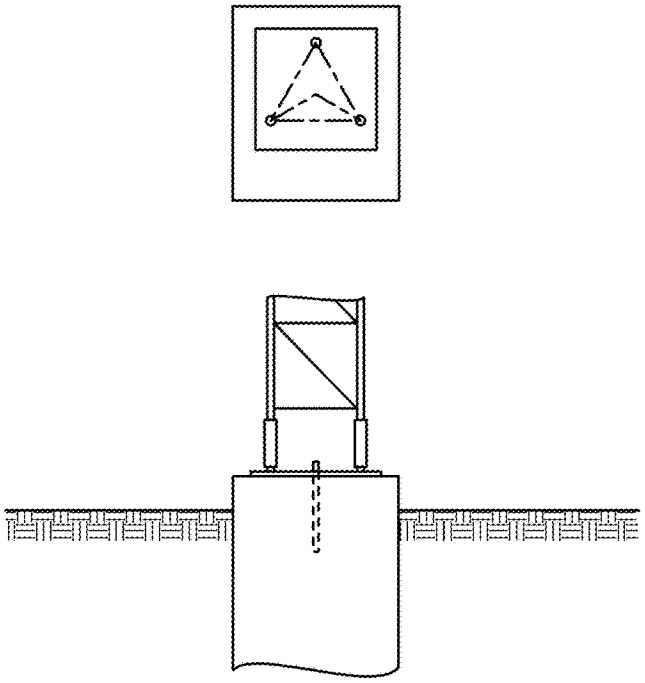
FIG. 1B is another schematic showing a tower mounted within a concrete foundation, partial below ground.
Figure 1A:
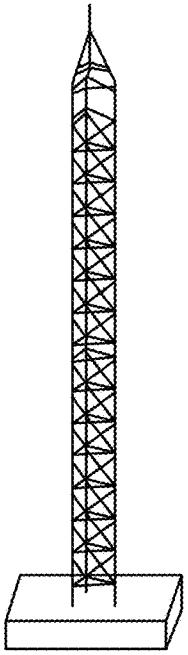
FIG. 1A is a schematic of a tower with a semi-permanent, concrete slab foundation.

In contrast, conventional antenna masts, such as, for example a Rohn mast, shown in FIGS. 1A-1C, are typically mounted by embedding the mast into a concrete foundation. Such concrete foundations are typically poured below ground, and, accordingly, require digging, drilling, or otherwise penetrating the ground. Mounting a vertical mast in this manner not only requires expensive equipment, for example for digging and/or pouring concrete, but also involves penetrating the ground, which may require surveying. This adds significant time and cost to deployment operations. Such towers may also employ guy wires, which connect points on the vertical mast to locations on ground. For typical Rohn towers, guy wires connect at relatively low angles (e.g., 35-50 degrees), which produces a relatively large area footprint—on the order of the tower height. In certain applications such as for example detection of methane emissions with infrared cameras mounted on a tower, the tower needs to be located close to the equipment to be monitored (e.g. tanks, separators, compressors) and such large area footprint for guy wires is not feasible as it impedes access by truck or other vehicles to such equipment.

Certain telecom towers, such as cellular towers manufactured by ARE Telecom & Broadband, come in solutions that use a portable tower base, to which ballast can be added in order to provide a foundation on which to mount a vertical mast. Typically, the vertical mast is connected to the base via a hinge, such that once the base is installed and ballast added the vertical mast is raised up, about the hinge, and locked in place.

Figure 2A:
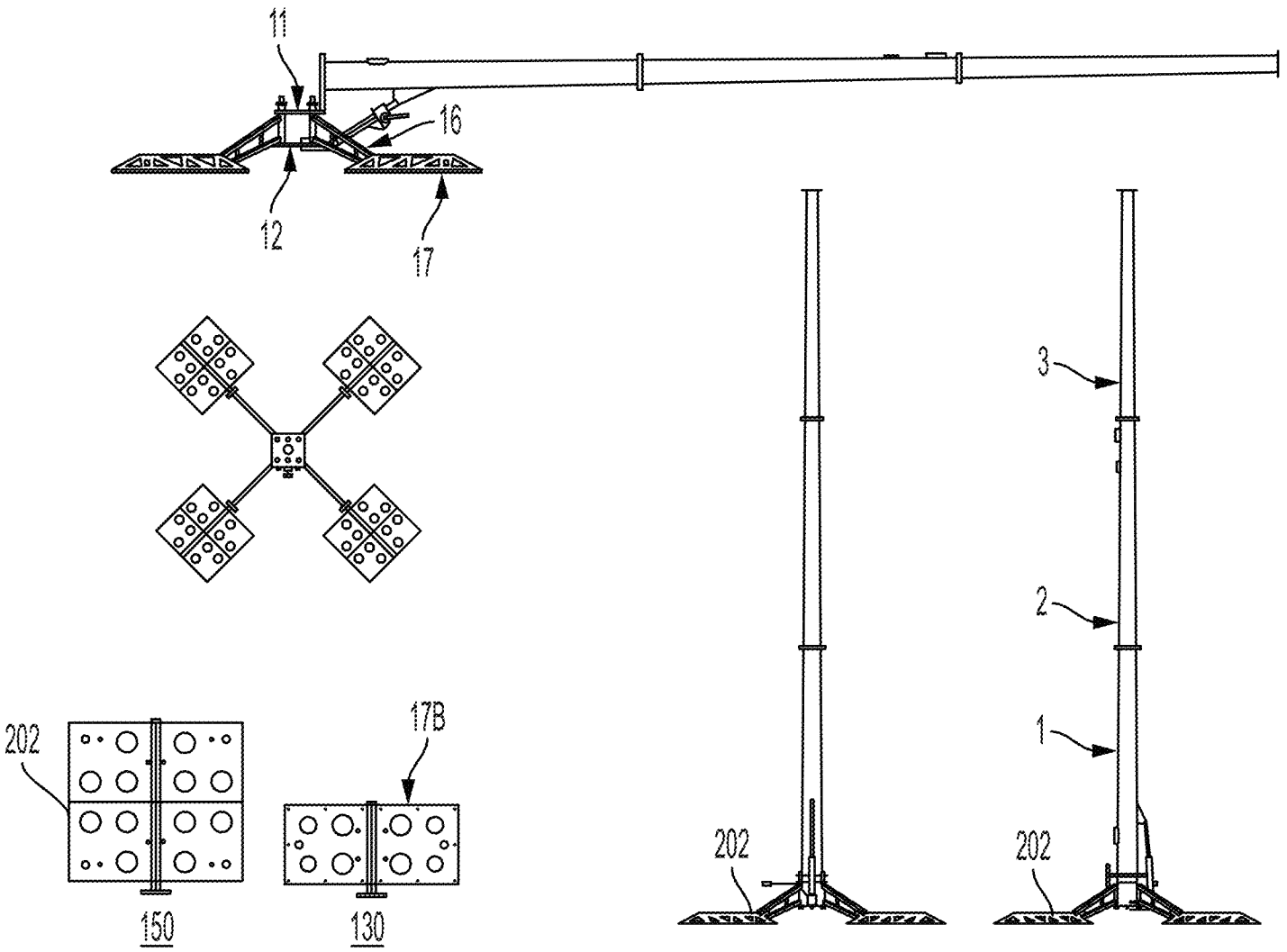
FIG. 2A is a schematic showing a monopole tower mounted on a leveling plate and connected to a base with baskets rigidly secured to legs.
Figure 2C:
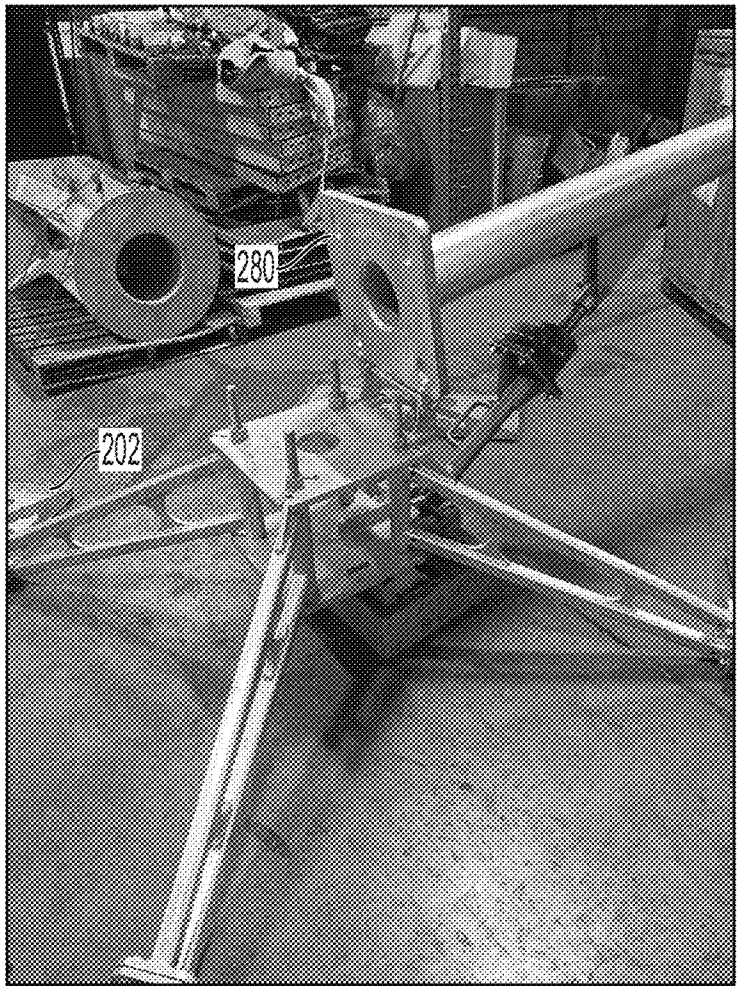
FIG. 2C is another picture showing a monopole tower mounted on a leveling plate and connected to a base with baskets rigidly secured to legs.
Figure 2B:
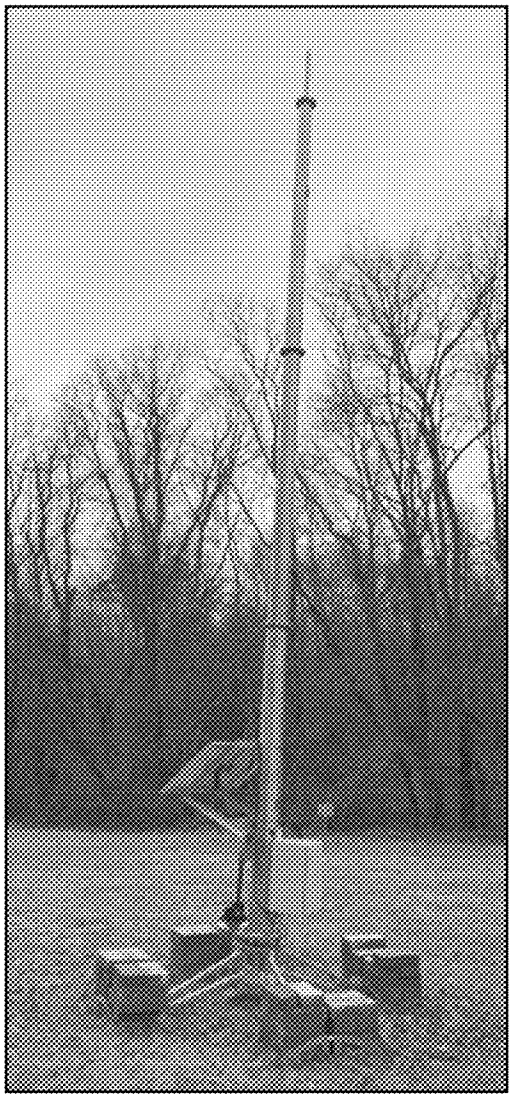
FIG. 2B is a picture showing a monopole tower mounted on a leveling plate and connected to a base with baskets rigidly secured to legs.

Conventional ARE towers such as the one shown in FIGS. 2A-C have a number of shortcomings. Among other things, ballast must be added to the tower base after the base is assembled, the design uses a single straight pole, which does not provide adequate stiffness and can flex/bend. The vertical mast is generally constructed out of steel, to provide survivability in high wind gusts. As a result, it is heavy and commonly requires a three to ten ton hydraulic jack to raise.

Apart from being complex and expensive to install, conventional tower designs such as the Rohn and ARE towers shown in FIGS. 1A-C and 2A-C are designed for survivability, and may sway and move in wind. Such motion may be acceptable for, e.g., radio transmission or cellular signal applications, but, as described in further detail herein, is highly undesirable in e.g., scanning imaging applications.

In certain applications, such as for example detection of methane emissions at upstream oil and gas sites, there is a need to erect a tower for a short period of time (days, weeks or months). Relocatability of tower and camera are desired in order to monitor a site, for example to establish a root cause, for intermittent emissions or to validate the success of a repair and to then be able to relocate such tower and camera to another site for the same type of monitoring. Trailer-based towers are available, however they either do not provide sufficient survivability in high wind gust conditions, they do not provide the required stiffness, or both. They may also require guy wires at a large angles, thus requiring a large (area) footprint.

A. Tower Overview

Figure 3:
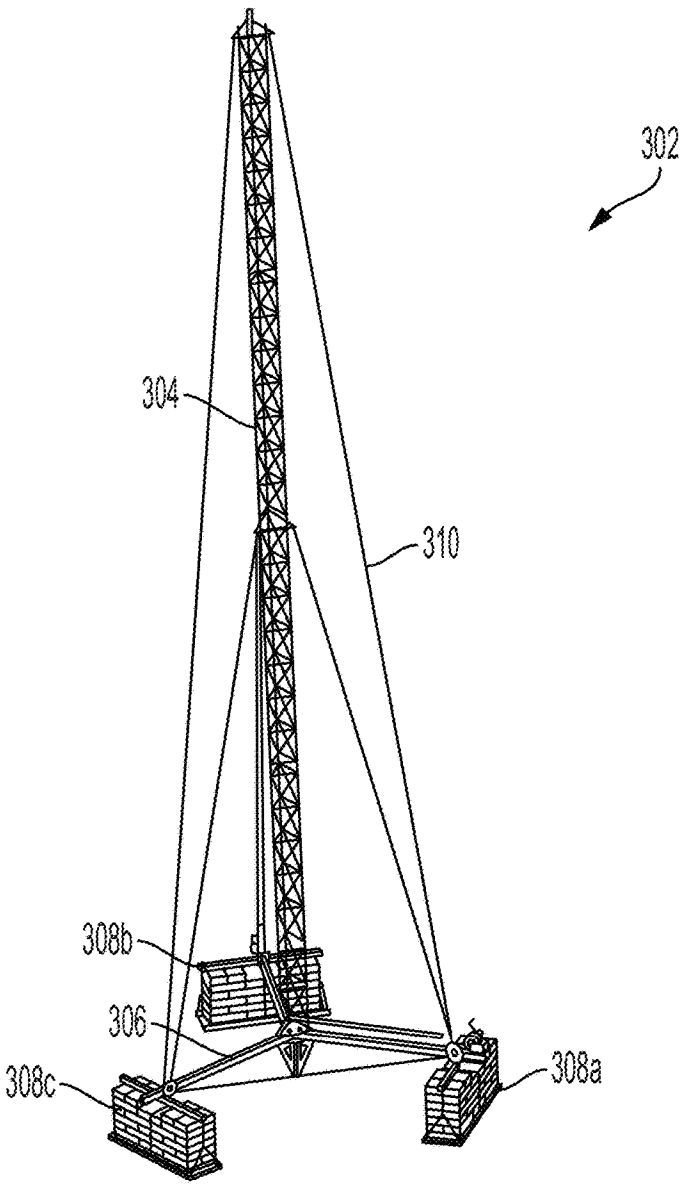
FIG. 3 is schematic showing an example relocatable and ballast agnostic tower, according to an illustrative embodiment.

FIG. 3 shows an example tower that utilizes certain features described herein that, among other things, provide improved stiffness, reduce on-ground footprint, and facilitate rapid on-site deployment and, in certain embodiments, do not require use of heavy equipment.

As shown in FIG. 3, example tower 302 comprises a vertical mast 304 mounted to a base 306. Base 306 in turn connects with one or more ballast components 308*a*, 308*b*, 308*c* (collectively 308) to provide a weighted foundation for supporting vertical mast 304. In certain embodiments, a tower such as example tower 302 may comprise one or more guy wires 310, each guy wire connecting a location on vertical mast 304 to a guy wire connection point at a particular ballast location (i.e., location of a ballast component).

Vertical mast 304 may be a single element or a multi-element structure. In certain embodiments, vertical mast 304 may comprise multiple vertical poles, connected to each other by multiple support members, for example forming a truss structure. For example, vertical mast 304 may be a Rohn tower section. Other implementations, e.g., that use other cross sectional geometries and/or truss designs may be used. These may include, for example, alternate brands and/or construction versions of a Rohn section, as well as other masts comprised of hollow tube sections stiffened by tensioned stays and/or spreaders, and utilize various truss structures. Example masts may include vertical poles and/or support members comprised of aluminum, steel, and other metals. In certain embodiments, a vertical mast comprises welded seamed tubing of aluminum or steel. In certain embodiments, vertical mast 304 may have a length (e.g., height, when raised) greater than or equal to about 20 feet, greater than or equal to about 40 feet, greater than or equal to about 50 feet, greater than or equal to about 60 feet, greater than or equal to about 70 feet, greater than or equal to about 80 feet, greater than or equal to about 90 feet, greater than or equal to about 100 feet.

B. Tower Base

Figure 4A:
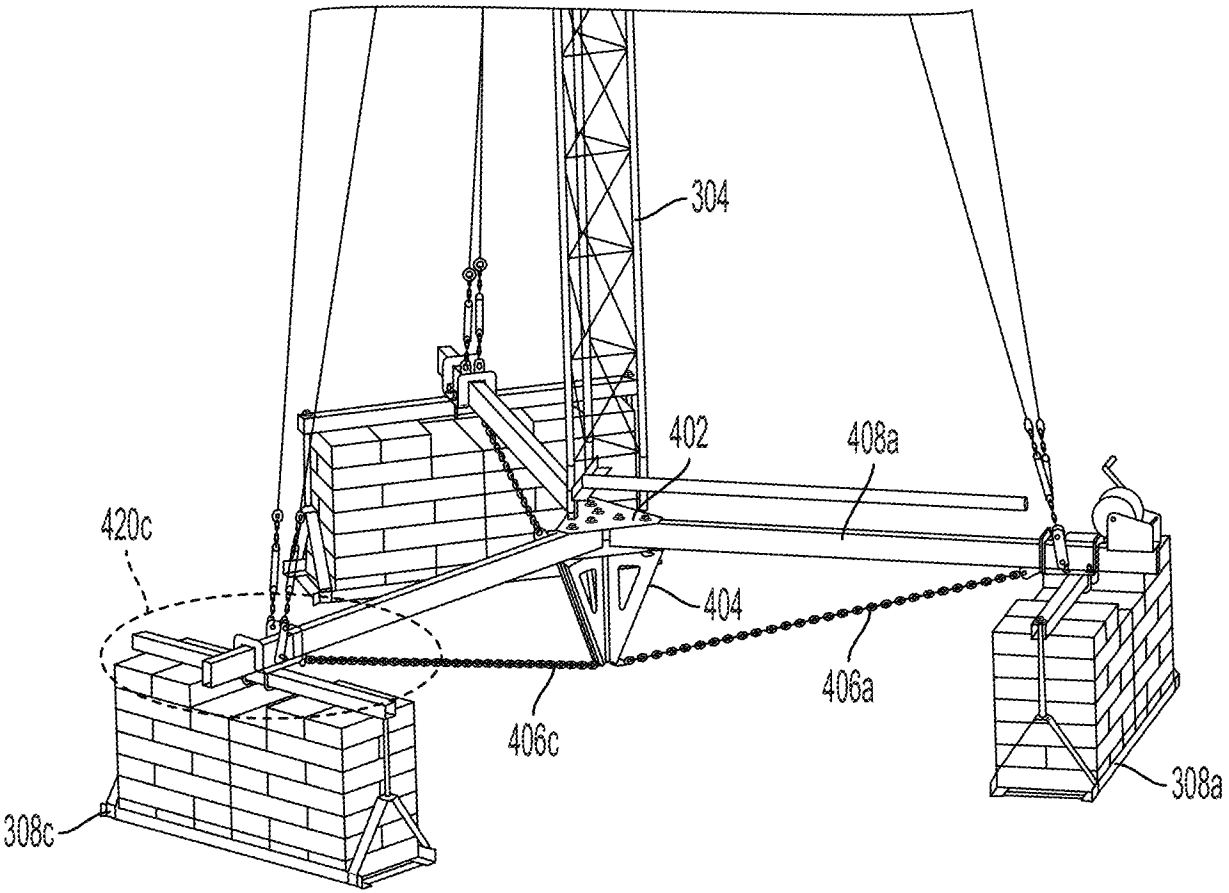
FIG. 4A is schematic showing an base portion of an example relocatable and ballast agnostic tower, according to an illustrative embodiment.
Figure 4B:
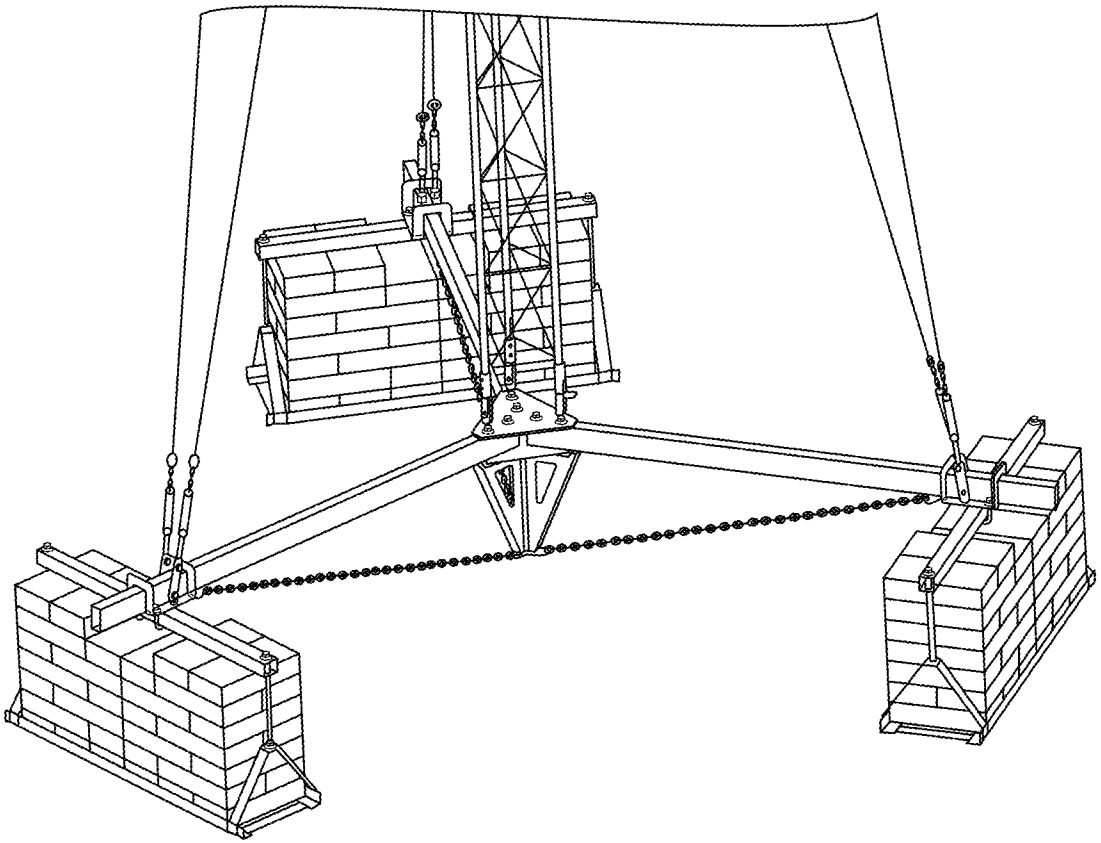
FIG. 4B is schematic showing an base portion of an example relocatable and ballast agnostic tower, according to an illustrative embodiment.

FIGS. 4A and 4B show an example base 306 in detail. As shown in FIGS. 4A and 4B, base 306 comprises a base plate 402 to which vertical mast 304 mounts, a kingpost 404, three kingpost stays 406*a*, 406*b*, and 406*c* (collectively 406) and three legs 408*a*, 408*b*, 408*c* (collectively 408). Legs 408 connect base 402 to ballast components 408. In certain embodiments, each of legs 408 are or comprise rectangular beams, for example as shown in FIGS. 4A and 4B, that can be connected to base plate 402 via a bolt passing through an aperture (e.g., hole) at an end of a leg. In certain embodiments, such rectangular beams can be connected to and directly support base plate 402, without a need for additional spacer elements. In certain embodiments, each particular leg connects to a particular (e.g., different) ballast component.

In certain embodiments, each leg of base 402 connects to a particular ballast component via a ballast adaptor 420*c*.

C. Ballast Adaptor

Figure 5A:
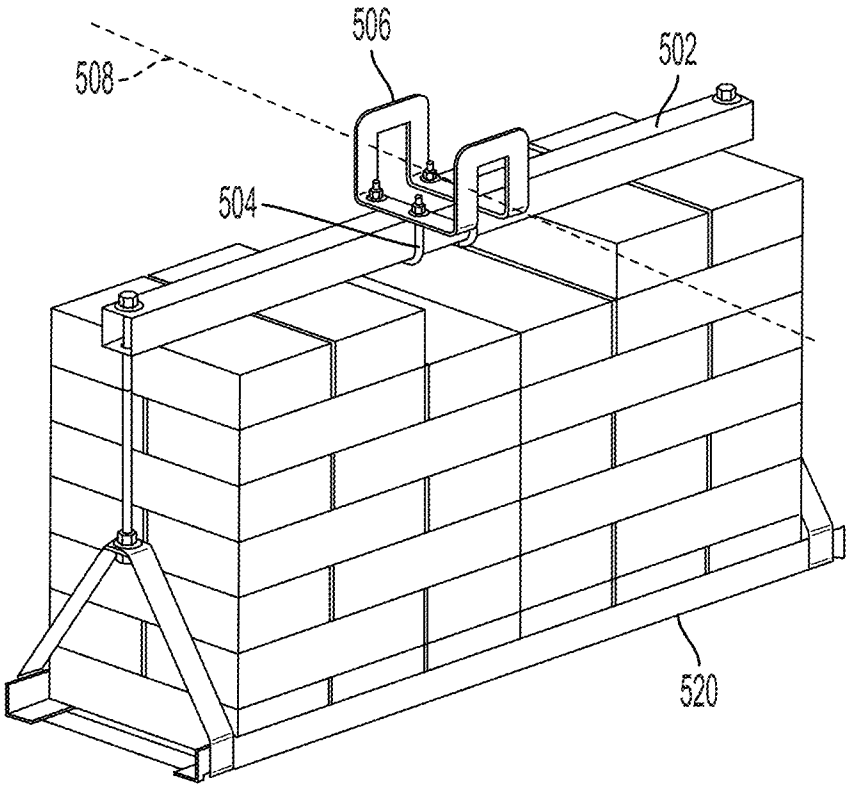
FIG. 5A is a schematic showing a ballast adaptor according to an illustrative embodiment.

Turning to FIG. 5A, in certain embodiments, a ballast adaptor comprises a ballast rail 502, a ballast mount 504, and a leg mount 506. As shown in FIG. 5A, ballast mount 504 comprises a first passage along a first axis, sized to accommodate ballast rail 502. Ballast rail 502 may be passed through the opening of ballast mount 504, thereby aligning it along the first axis. Ballast mount 504 connects with leg mount 506. In certain embodiments, leg mount 506 comprises an opening directed along a second axis 508, through which a leg of base 306 may pass. Ballast mount and/or leg mount 506 may be a single (e.g., continuous) element or may comprise multiple components. For example, ballast mount 504 may comprise two or more U-hooks, secured to a lower surface of leg mount 506 to create a passageway through with ballast rail 502 can be placed.

As shown in FIG. 5A, in this manner, ballast adaptor connects each leg of a base with a ballast component. In certain embodiments, for example as shown in FIG. 5A, leg mount 506 is connected and oriented with respect to ballast mount 504 such that the second axis is substantially perpendicular to the first axis. In this manner, a ballast adaptor as described herein may orient each leg above and approximately perpendicular to a corresponding ballast rail.

Accommodating Various Ballast Types

In this manner, among other things, ballast adaptors as described herein may be used to as, e.g., a standardized connection with which to connect legs of base 406 to ballast components that utilize a variety of different types of ballast blocks for weight.

For example, in certain embodiments, ballast adaptor connects to a tray 520, which may be loaded with weight, such as concrete bricks or paving stones. A number of concrete blocks bricks or paving stones with which tray 520 is loaded may be varied, for example to achieve a desired weight, for example in order to survive a certain maximum wind gust and/or obtain a certain (e.g., desired) stiffness of the tower.

Figure 5C:
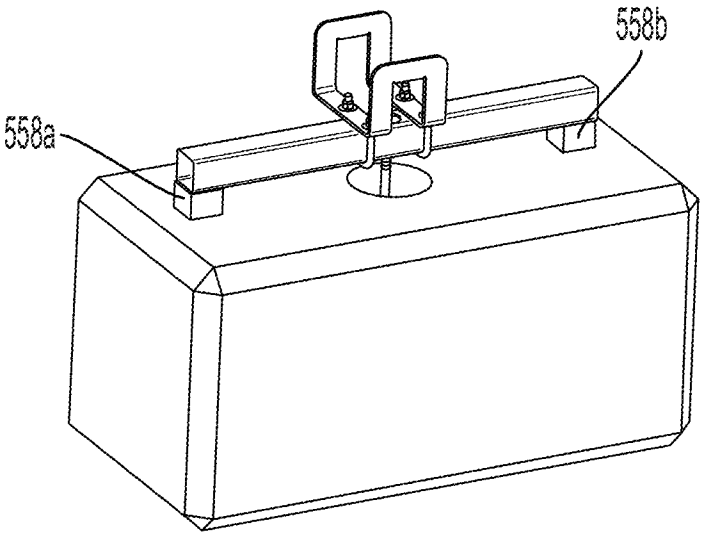
FIG. 5C is a schematic showing a ballast adaptor for connecting to a pre-cast concrete block, according to an illustrative embodiment.
Figure 5B:
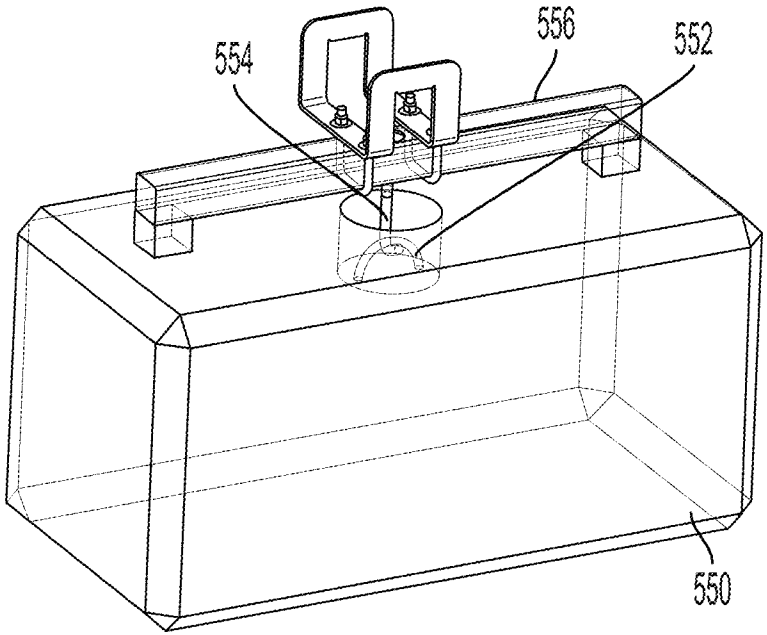
FIG. 5B is a schematic showing a ballast adaptor for connecting to a pre-cast concrete block, according to an illustrative embodiment.

Turning to FIGS. 5B-5E, a ballast adaptor as described herein may be used to mount other types of weight, such as solid concrete ballast blocks, which may be formed by pouring concrete into pre-cast molds and/or purchased at low cost. In certain embodiments, such concrete blocks are readily available from multiple suppliers. Two examples of shapes of concrete blocks are shown in FIGS. 5B and 5C as well as 5D and 5E. In certain embodiments, concrete road barriers may also be employed as ballast (e.g., commonly referred to as Jersey Barriers).

In certain embodiments, additionally or alternatively to the tray mechanism shown in and described with respect to FIG. 5A, one or more spacer components and/or hooks may be affixed to top ballast rail to secure weight, such as a solid ballast block, to top ballast rail. For example, as shown in FIGS. 5B-5E, concrete ballast blocks often have a u-shaped hook embedded in an upper surface. For example, turning to FIG. 5B, a poured concrete block 550 comprises an embedded metal hook 552. A J-hook 554 connected to a top ballast rail 556 along with spacer components 558*a*, 558*b* can, accordingly, in certain embodiments be used to maintain tension and securely affix a ballast block 550 to top ballast rail 556.

In certain embodiments, a ballast rail 556 may be securely attached to a ballast block by connecting a J-hook, U-bolt, etc. (e.g., 554) to a loop or hook (e.g., 552) embedded in a ballast block (e.g., 550) and tightening the connection, for example, using threaded nuts and washers. In this manner, a ballast rail may be connected tightly, via e.g., a J-hook, against a top surface of a ballast block (e.g., with one or more spacers in between), to create a rigid connection. In certain embodiments, a ballast rail may be secured to a ballast block prior to delivery to a site, such that, for example, the assembled ballast rail can be used to facilitate unloading and positioning the ballast on site.

Figure 5E:
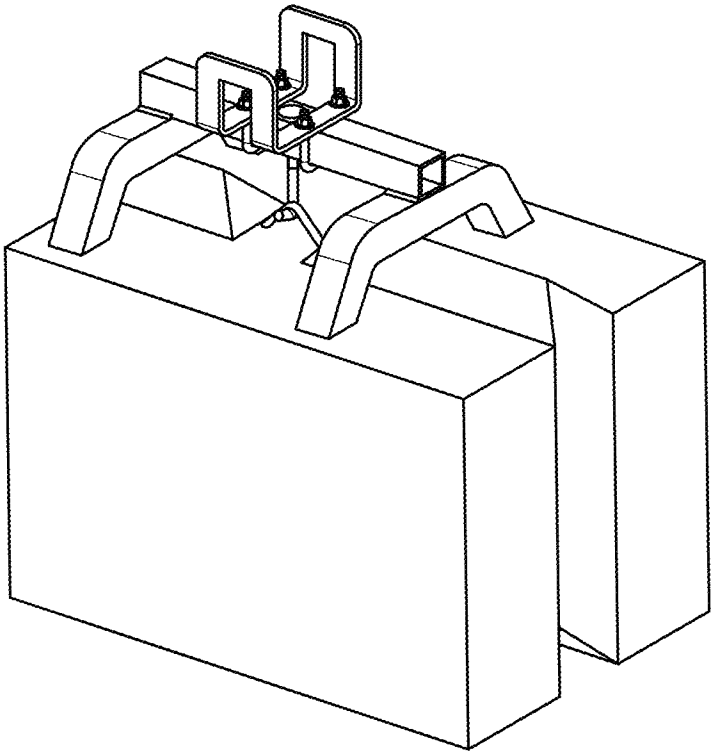
FIG. 5E is a schematic showing a ballast adaptor for connecting to a pre-cast concrete block, according to an illustrative embodiment.
Figure 5D:
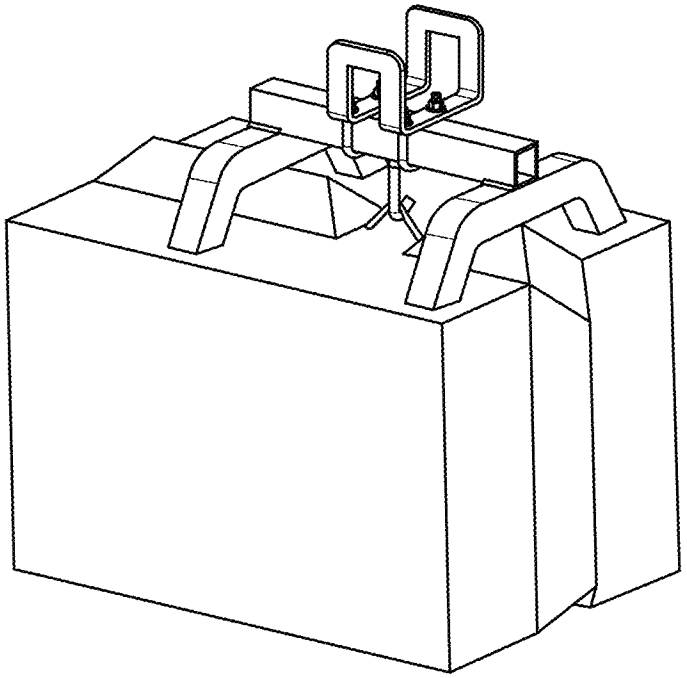
FIG. 5D is a schematic showing a ballast adaptor for connecting to a pre-cast concrete block, according to an illustrative embodiment.

Poured concrete blocks such as the blocks shown in FIGS. 5B and 5C commonly come with embedded metal hooks 552 as shown in FIGS. 5B and 5C, by default. As shown in FIGS. 5D, and 5E, this approach can be utilized to secure a variety of different ballast block shapes to a ballast rail. Accordingly, a variety of readily available ballast blocks types can be used, without requiring modification.

Ballast Positional Tolerance

Figure 6B:
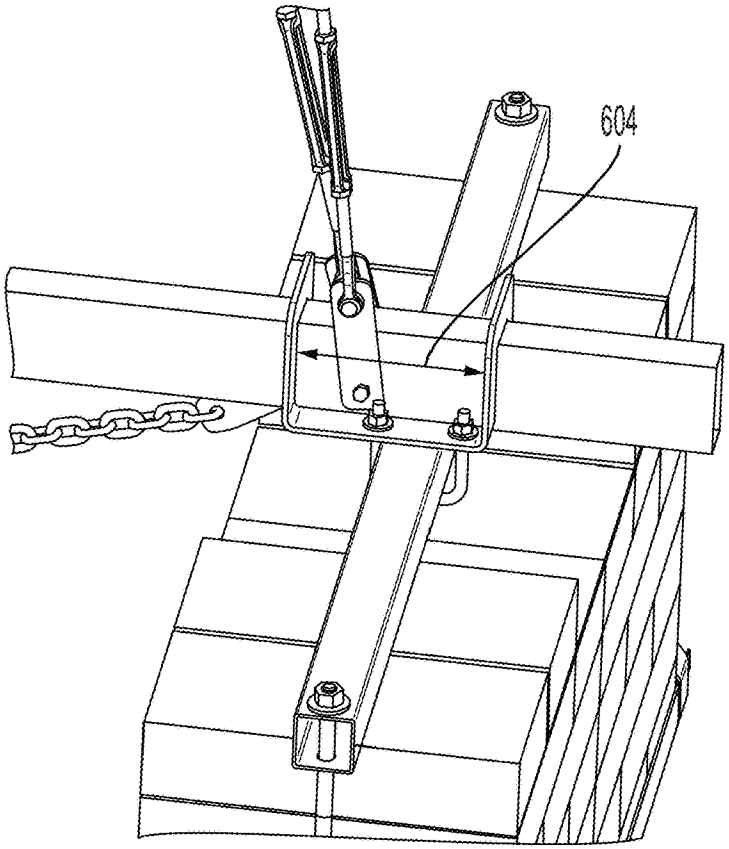
FIG. 6B is a schematic showing range of motion provided by a ballast adaptor along a second axis (degree of freedom), according to an illustrative embodiment.
Figure 6A:
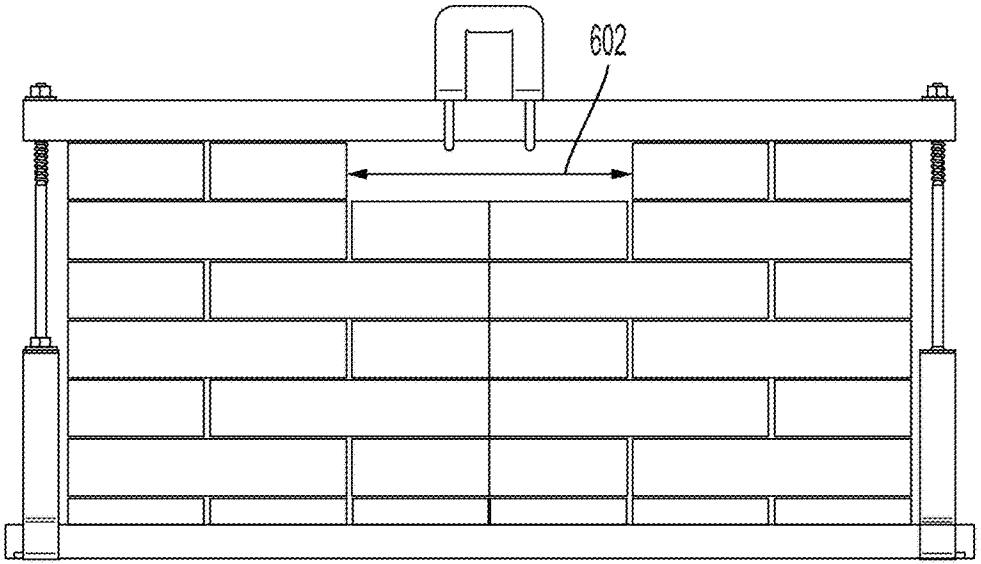
FIG. 6A is a schematic showing range of motion provided by a ballast adaptor along a first axis (degree of freedom), according to an illustrative embodiment.

Turning to FIGS. 6A and 6B, in certain embodiments, ballast adaptors as described herein provide for positional degrees of freedom, allowing for, among other things, tower designs as described herein to tolerate variation in ballast positions on the ground. Delivery of the ballast may be at a prior time to the erection of the tower and the heavy lift machinery necessary to make minor location adjustments may not be present.

In particular, as shown in FIGS. 6A and 6B, ballast mount 504 may be translated along ballast rail, thereby providing a range of positional freedom along a first axis. In certain embodiments, ballast weight may be shaped and/or spacers, such as those shown in FIGS. 5B-5E, to create a pocket that allows for ballast mount 504 to be translated along ballast rail within a particular range 602. In certain embodiments, leg mount allows for a leg to be translated through its opening, thereby providing a range of positional freedom along a second axis 604. As described herein, in certain embodiments, leg mount 506 may be affixed and oriented with respect to ballast mount 504 such that first axis is substantially perpendicular to second axis, thereby providing for two degrees of freedom of motion.

In certain embodiments, this approach provides advantages over other, conventional tower designs in which, for example, ballast trays are bolted, welded, or otherwise connected to a tower base in a restrictive fashion that does not allow positional freedom (see, e.g., 202 in FIG. 2A and FIG. 2C). In particular, in such conventional designs, ballast trays or other approaches of loading ballast are in a fixed position with respect to a tower base, effectively creating a single unit. As a result, conventional tower base must be deployed together with ballast weight and/or require extremely tight tolerances and careful alignment of ballast weights with respect to other components.

In contrast, positional freedom afforded by ballast adaptors as described herein allows for tower bases to be deployed separately from ballast weight, in a modular fashion. The ability to deploy tower components separately from ballast has a number of significant advantages in how towers can be deployed, among other things, reducing costs, limiting need for coordination between various entities, such as technicians who construct a tower and vendors who provide ballast weights, speeding up deployment, and reducing overall complexity.

For example, instead of coordinating ballast weight delivery with tower construction (as would be required for conventional tower designs), by using a modular approach provided for by ballast adaptor technology as described herein, ballast weight can be delivered to sites where towers are to be placed first, on a flexible schedule without regard to when tower components themselves are to be installed.

For example, by virtue of the positional flexibility provided by ballast adaptors as described herein, once locations of prospective towers are identified, corresponding locations of ballast weight can be marked, simply by, e.g., spray painting ground, placing flags, etc.

Figure 7A:
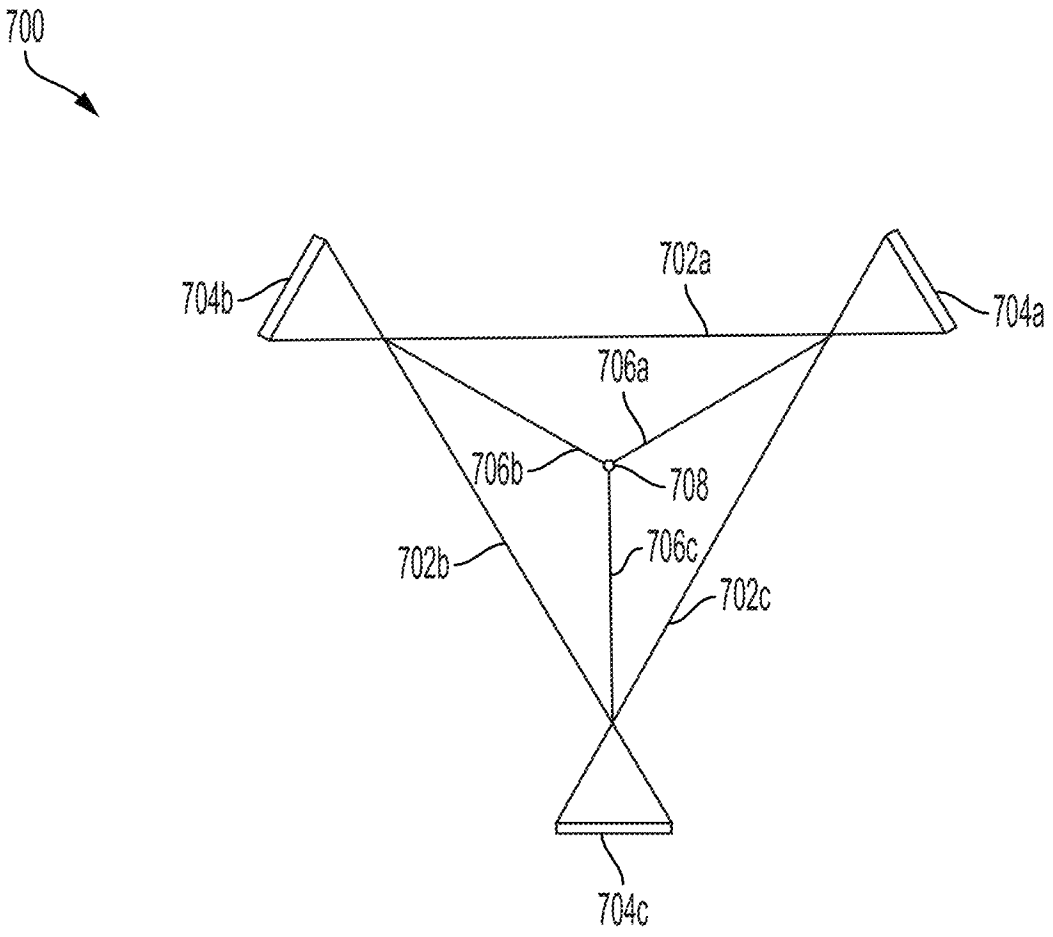
FIG. 7A is a schematic showing a template apparatus for positioning ballast prior to deployment of a tower, according to an illustrative embodiment.

In certain embodiments, a template apparatus may be used to ensure that ballast is located within location tolerance zones afforded by the ballast adaptor approach as described herein. FIG. 7A shows a top view of an example template apparatus 700 comprising flexible lines. In certain embodiments, template apparatus such as shown in FIG. 7A comprise a first set of lines (e.g., ropes) 702*a*, 702*b*, 702*c* (collectively 702) with short rails 704*a*, 704*b*, 704*c* (collectively 704) tied at their ends, e.g., similar to handles on a water ski rope. A second, radial, set of lines 706*a*, 706*b*, 706*c* (collectively 706) can be used to orient the first set of lines 702 with rails 704 attached thereto at substantially equal rotational angles (e.g., 120 degrees) about a central point 708, and, in certain embodiments, the rails may naturally pull taut perpendicular to radial lines.

In certain embodiments, a location of a prospective center of a tower base may be identified at a site, and would be located and a template apparatus (e.g., as shown in FIG. 7A) attached to a stake or heavy object at the prospective center location. For example, central point 708 may be a ring, through which a stake is passed. The first and second sets of lines may be stretched out in desired directions to, e.g., establish a direction a future tower would fold down. Rails 704, once stretched out, establish inner edges of ballast locations and thereby identify approximate location for the ballast weight to be placed. In certain embodiments, such edges may be used as a starting point for stacking ballast bricks and/or a guide to mark, e.g., via spray paint, flags, etc., on ground for later delivery of ballast weight.

Figure 7B:
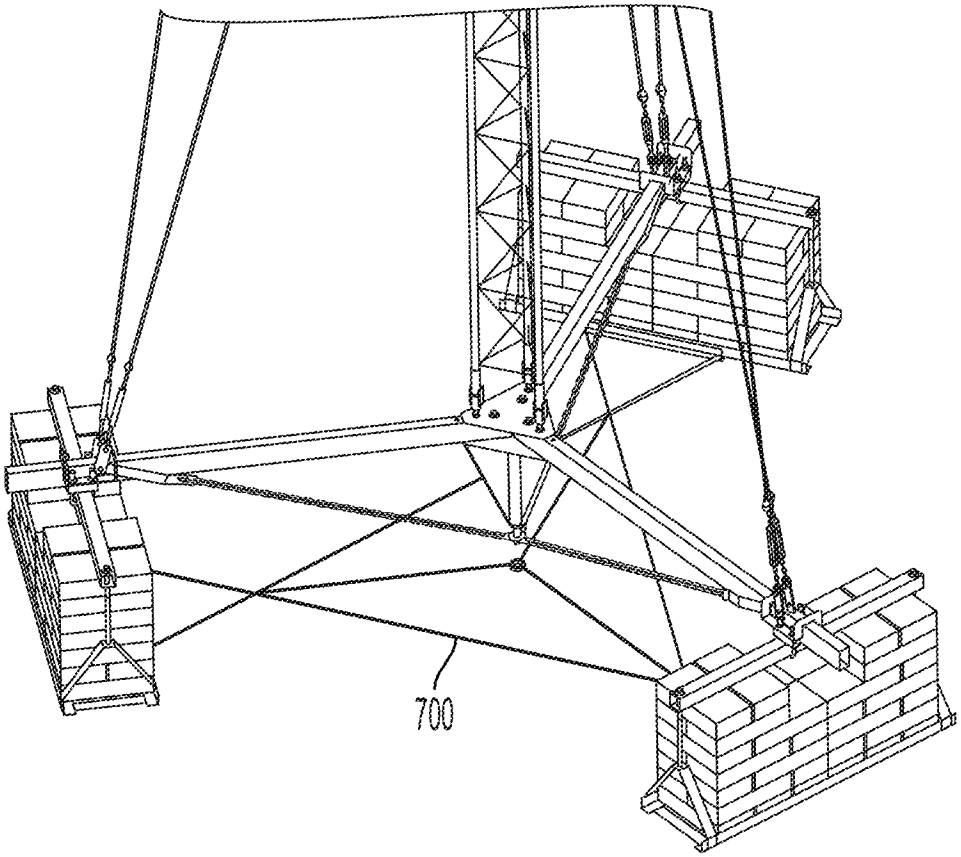
FIG. 7B is a schematic showing a tower and ballast located on top of a template apparatus as shown in FIG. 7A, according to an illustrative embodiment.

FIG. 7B shows an example tower placed above a template apparatus 700.

D. Guy Wire Connection

Figure 8A:
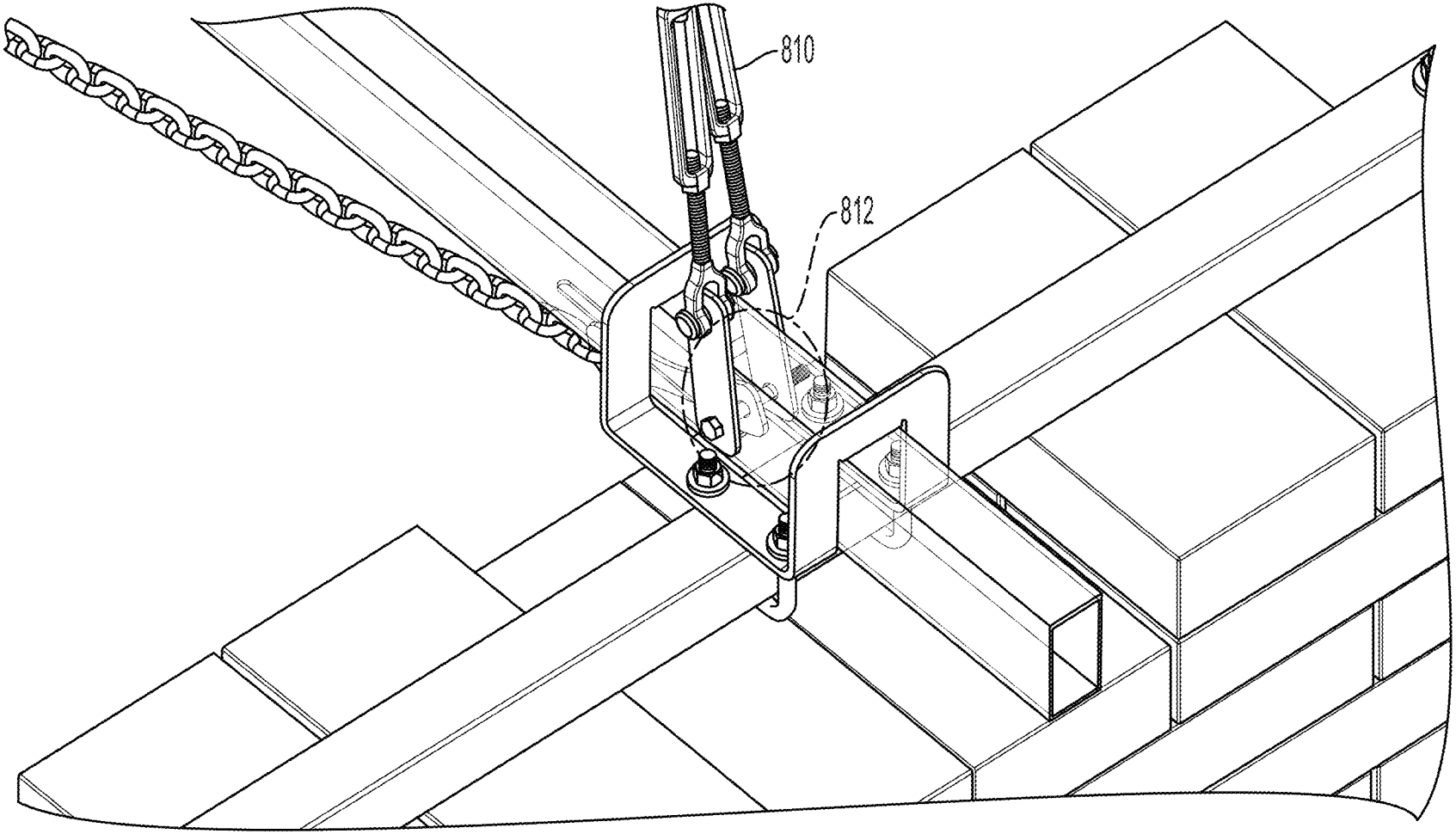
FIG. 8A is a schematic showing connection of a guy wire to a ballast location at a guy connection point, according to an illustrative embodiment.
Figure 8B:
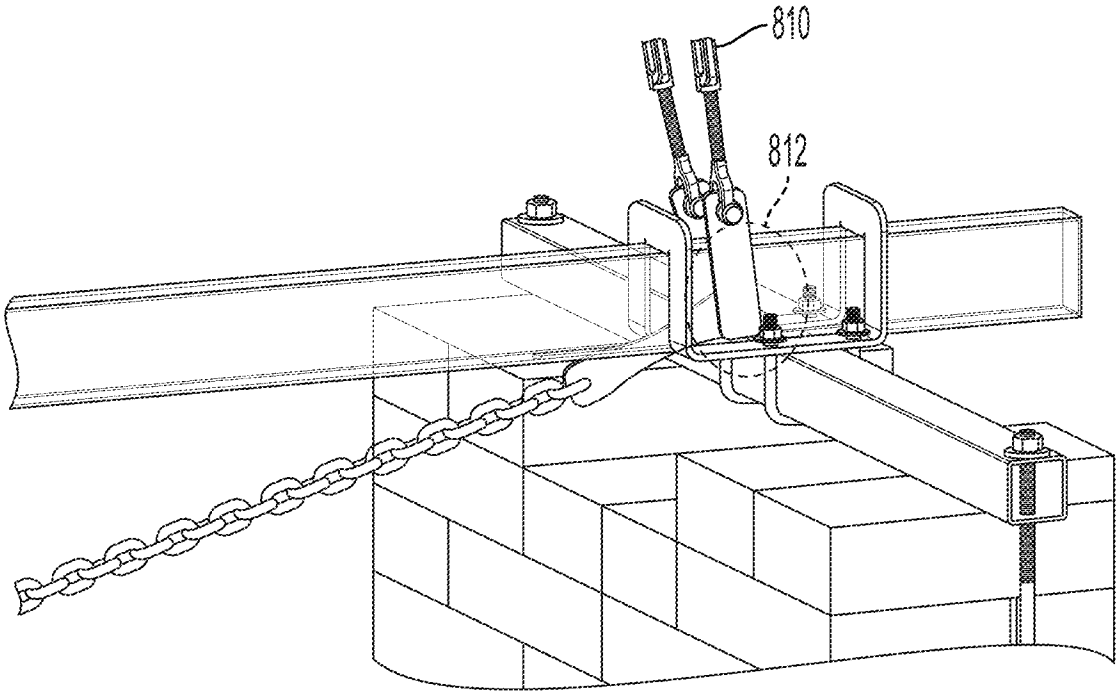
FIG. 8B is a schematic showing connection of a guy wire to a ballast location at a guy connection point, according to an illustrative embodiment.

Turning to FIG. 8A and FIG. 8B, in certain embodiments, guy wires 810 can be connected to legs at a connection point (a guy attachment point 812) situated directly on top of ballast, e.g., at a location of leg mount. Providing for guy attachment points 812 to be located directly over a center of gravity of the ballast eliminates, or greatly reduces bending loads in the structure which translate into a loss of stiffness. In certain embodiments, attaching multiple guy wires (e.g., all guy wires that connect various respective locations on a vertical mast to a single particular ballast component) at a single point, among other things, allows for higher tensioned guy wires to be used without inducing bending loads on the legs, which improve stiffness of the tower without increasing weight. Moreover, in certain embodiments, by utilizing a kingpost truss, as described herein (e.g., in Section E, below) that connects guy attachment points on legs and/or ballast adaptors to a central location beneath the base plate, increased tension in guy wires can be maintained, further providing for enhanced rigidity/stiffness.

In contrast, monopole towers, such as those shown in FIG. 2A are unstayed, and obtain stability solely from anchoring at their base, to a foundation. Accordingly, they (monopole towers) act as vertical cantilevers and have inherent flexibility which results in swaying under wind loads. As described in further detail herein, such motion may be acceptable for radio transmission applications, but is highly undesirable for imaging applications and especially scanning based imaging applications such as those described herein.

E. Kingpost Truss

Figure 9A:
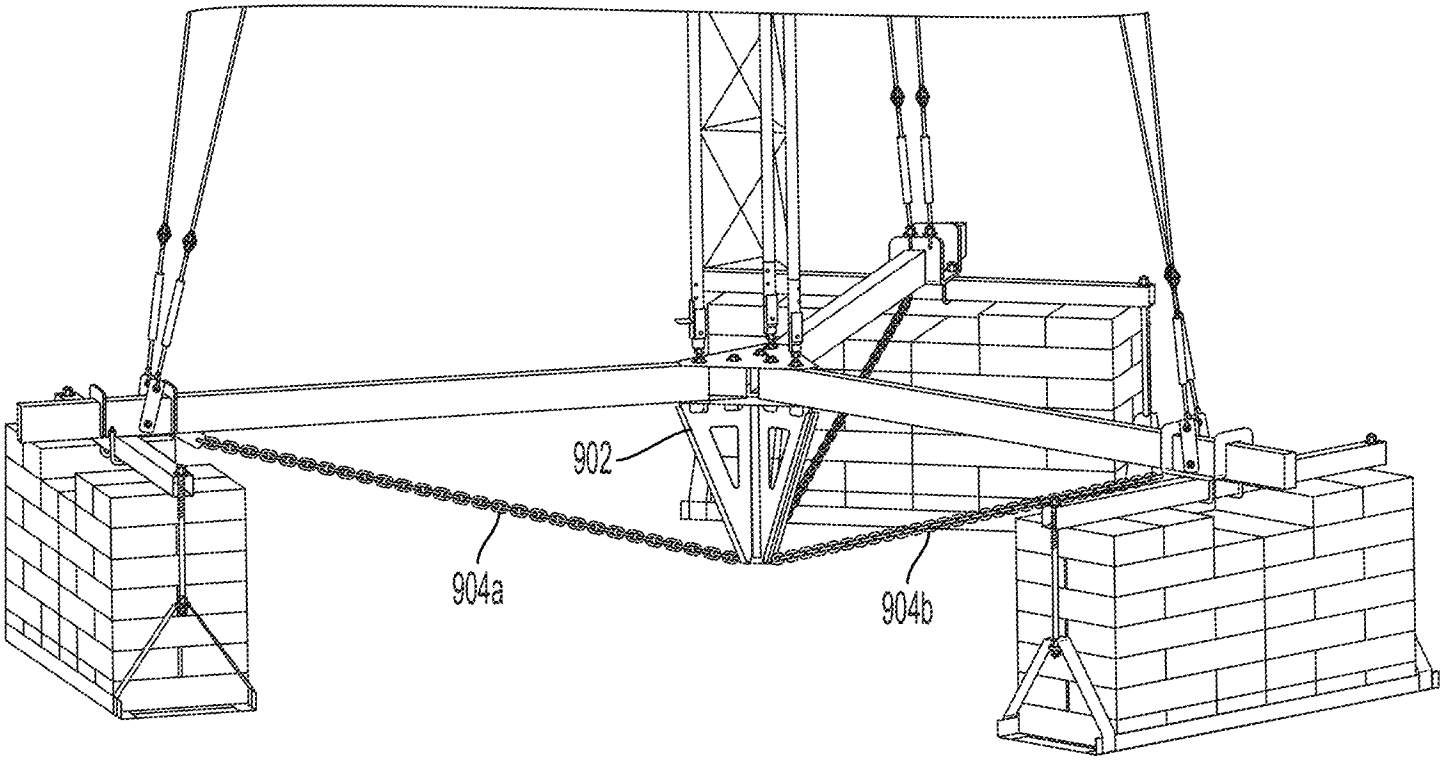
FIG. 9A is a schematic illustrating connection of kingpost stays to a kingpost, according to an illustrative embodiment.
Figure 9C:
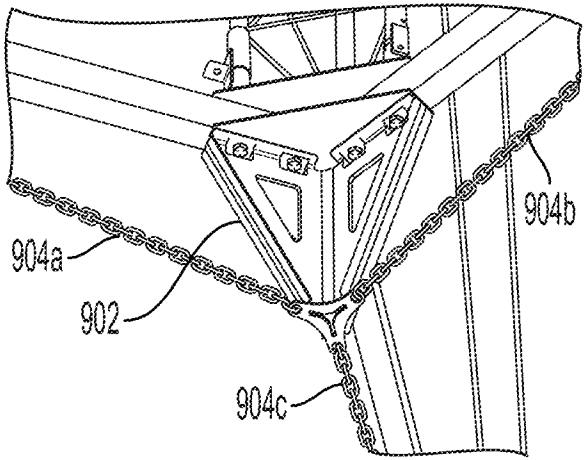
FIG. 9C is a schematic illustrating connection of kingpost stays to a kingpost, according to an illustrative embodiment.
Figure 9B:
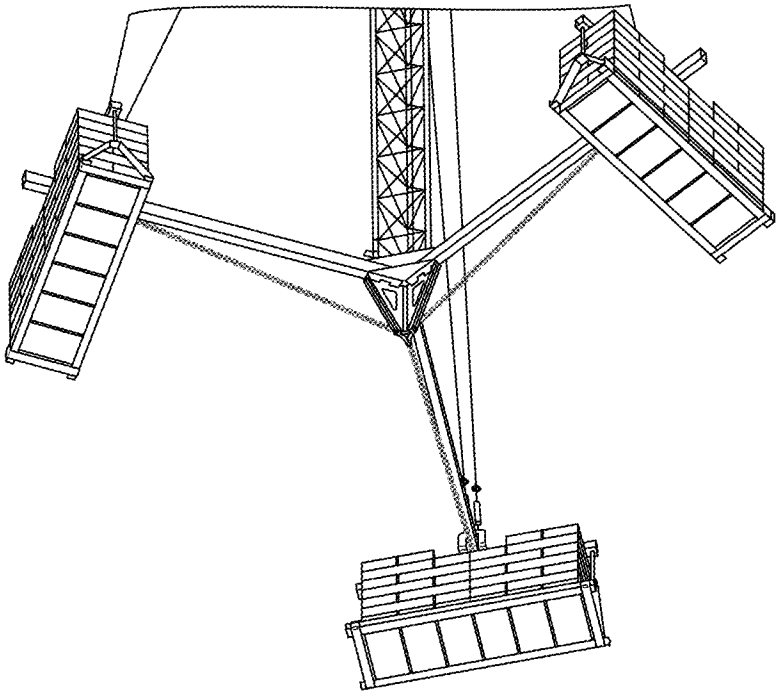
FIG. 9B is a schematic illustrating connection of kingpost stays to a kingpost, according to an illustrative embodiment.
Figure 9D:
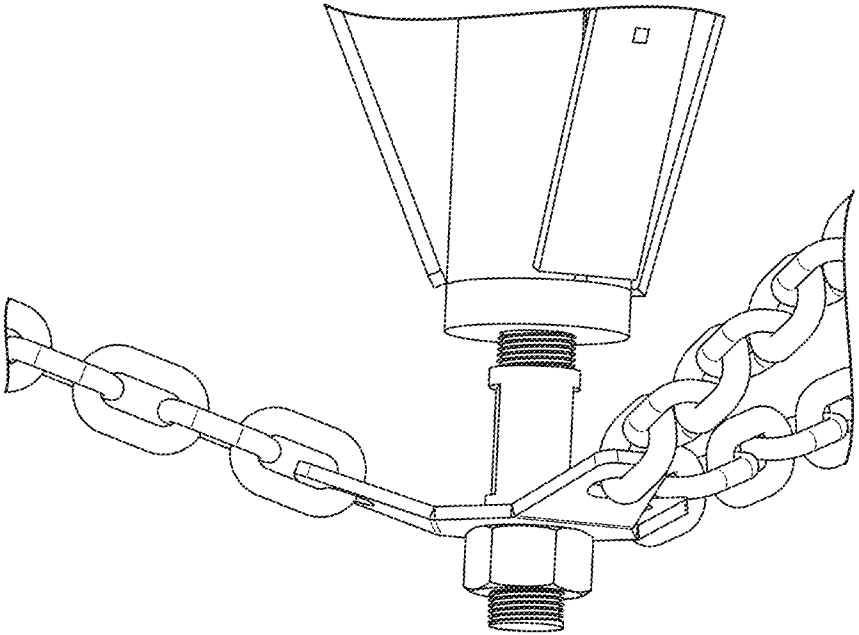
FIG. 9D is a schematic illustrating connection of kingpost stays to an apex of a kingpost via a jack screw, according to an illustrative embodiment.
Figure 9F:
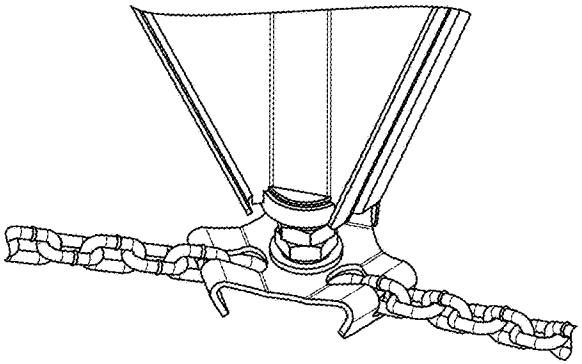
FIG. 9F is a schematic illustrating connection of kingpost stays to an apex of a kingpost via a clip mechanism, according to an illustrative embodiment.
Figure 9I:
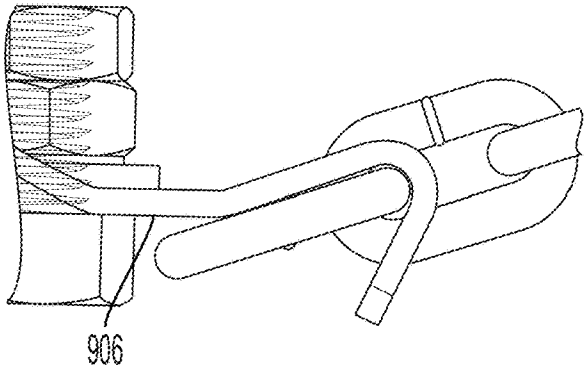
FIG. 9I is a schematic illustrating connection of kingpost stays to an apex of a kingpost via a clip mechanism, according to an illustrative embodiment.
Figure 9H:
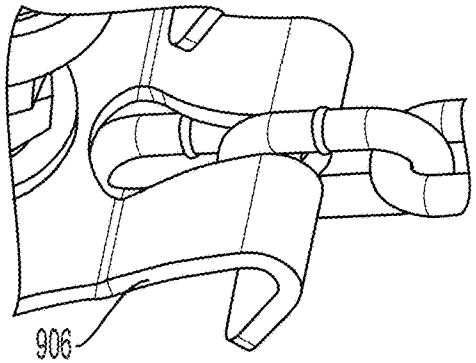
FIG. 9H is a schematic illustrating connection of kingpost stays to an apex of a kingpost via a clip mechanism, according to an illustrative embodiment.
Figure 9E:
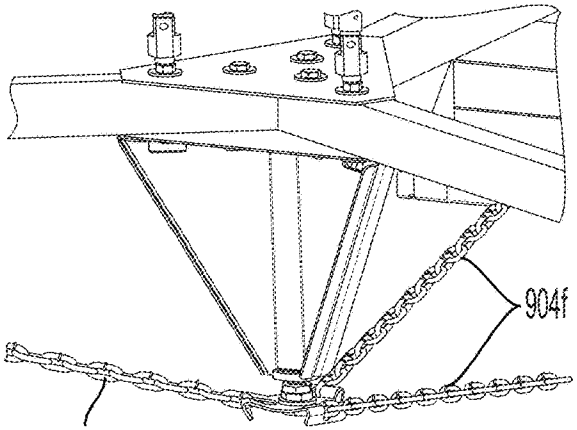
FIG. 9E is a schematic illustrating connection of kingpost stays to an apex of a kingpost via a clip mechanism, according to an illustrative embodiment.
Figure 9G:
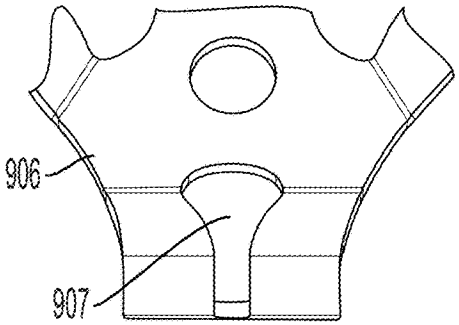
FIG. 9G is a schematic illustrating connection of kingpost stays to an apex of a kingpost via a clip mechanism, according to an illustrative embodiment.

Turning to FIGS. 9A-9J, in certain embodiments, tower base structures described herein comprise a kingpost truss feature comprising a kingpost 902 and kingpost stays 904*a*, 904*b*, 904*c* that improves stiffness of the tower base and reaction loads to the kingpost stays and out to the guy and at the same time allows for higher tensioning of the guy wires. In certain embodiments, kingpost is a heavy, sturdy post (e.g., sheet metal) oriented downwards from base plate, with an apex a distance below base plate. As shown in FIG. 9A, legs of tower base all lie in a same plane, with kingpost oriented and having an apex extending substantially perpendicular downward with respect to the plane in which the legs of the tower base lie. A plurality of (e.g., three) kingpost stays connect between a lower apex of kingpost and ballast components. As shown in FIG. 9D, a tensioning mechanism may be placed a bottom of kingpost to provide for tensioning of kingpost stays. In the particular example shown in FIG. 9D, a jack screw element that tensions all stays simultaneously is used.

Figure 9J:
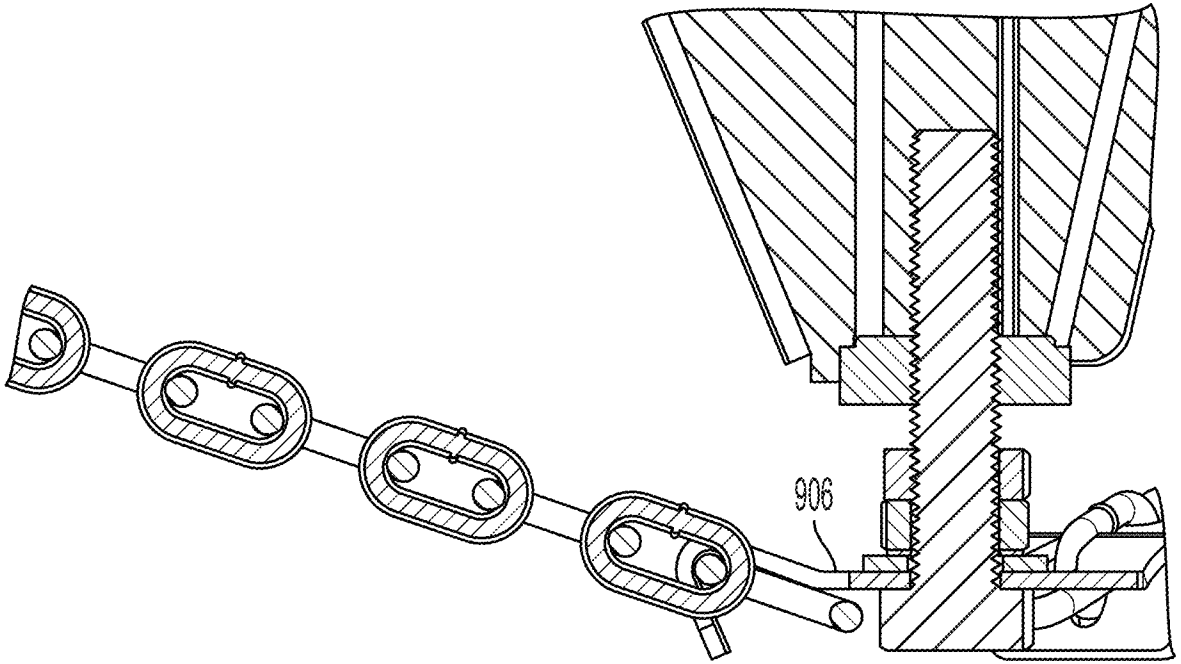
FIG. 9J is a schematic illustrating connection of kingpost stays to an apex of a kingpost via a clip mechanism, according to an illustrative embodiment.

Additionally or alternatively, in certain embodiments, for example as shown in FIG. 9E-9J, a clip 906 may be used to anchor and/or tension kingpost stays. In certain embodiments, the approach shown in FIGS. 9E-9J avoids a need for shackles and/or a clevis pin. To connect stays the bottom of the kingpost, a portion of a stay may be placed through a clearance hole in the clip, and re-oriented to create a tight/snug connection. For example, where stays (e.g., 904*d*, 904*e*, 904*f*) comprise one or more chain links, as shown in FIGS. 9E-J, a particular (e.g., distal) chain link may be dropped through a snug clearance hole, re-oriented 90 degrees, and slid outwardly into a slot oriented in a direction that prevents the particular link from moving out of the clip (e.g., along a direction of tension along the stay), thereby securing the stay. It is believed that there is little chance of sufficient slack and/or random forces changing an orientation of the chain link so as to cause it to come uncoupled. As shown in FIG. 9J, in certain embodiments, a central threaded bolt in the bottom end of the kingpost may exert a force on the clip and tension all stays simultaneously.

In certain embodiments, each kingpost stay connects with ballast component at a guy wire connection point. As described herein, among other things, this approach dramatically minimized bending, increases overall stiffness, and allows increased tension in guy wires. Without wishing to be bound to any particular theory, in certain embodiments the gusset structure of the kingpost and/or any equivalent truss directly conveys loads from tower legs to the kingpost stays as compressive or tensile elements, without adding elements subjected to bending Eliminating bending elements in this manner greatly reduces sway at the top of the tower due to flexibility of the foundation. Accordingly, in certain embodiments, the inherent elasticity of the guy wires is the determinant of the tower stiffness. In certain embodiments, use of synthetic high strength materials may increase stiffness without use of heavy steel cables.

F. Adjustable Couplings

Figure 10A:
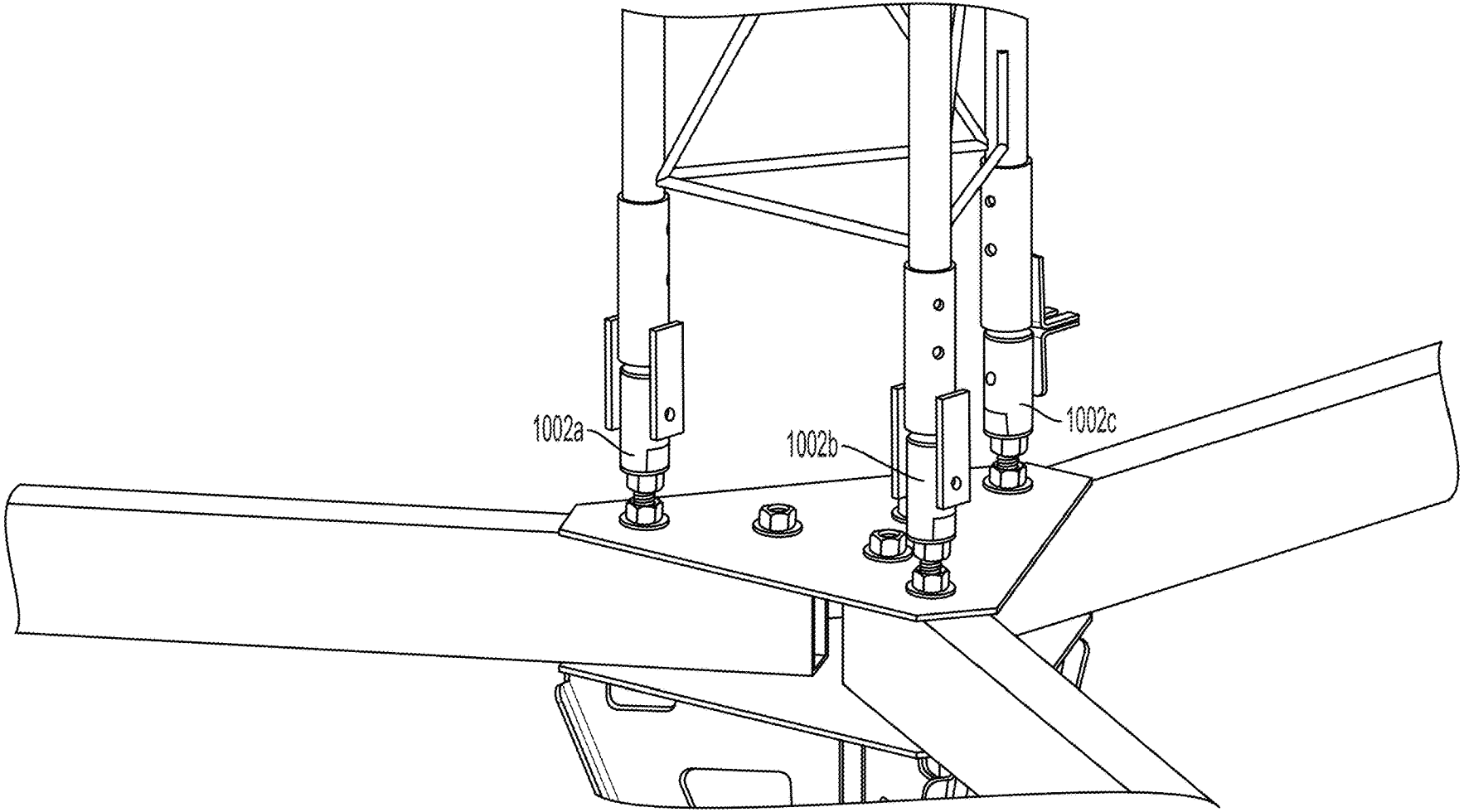
FIG. 10A is a schematic illustrating how an open frame tower may be mounted to a base plate via adjustable couplings, according to an illustrative embodiment.
Figure 10B:
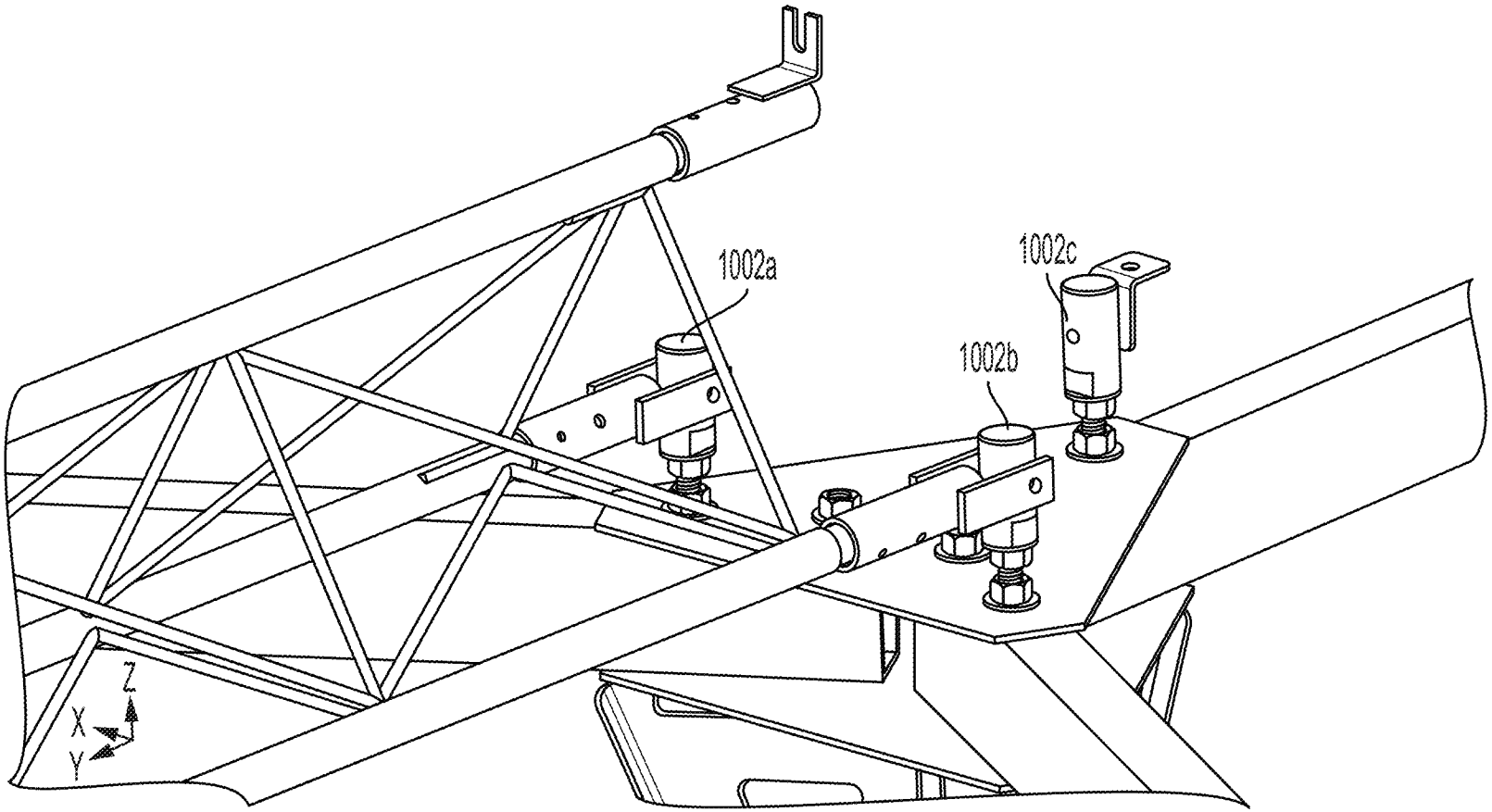
FIG. 10B is a schematic illustrating how an open frame tower may be mounted to a base plate via adjustable couplings, according to an illustrative embodiment.

Turning to FIGS. 10A and 10B, in certain embodiments the base plate comprises multiple adjustable couplings (e.g., solid posts with substantially flat upper surfaces acting as, e.g., feet to support vertical posts of the vertical mast), each matched to a vertical post of the vertical mast. Each adjustable coupling has an upper surface that supports a matching vertical post of the vertical mast. In certain embodiments, this approach is particularly well adapted to accommodate a Rohn tower section, or other tower section comprising multiple vertical posts forming an open frame, as described herein. In certain embodiments, a subset (e.g., a front two)

of the adjustable couplings comprise hinged connectors that connect them to their matching vertical posts of the vertical mast. For example, in certain embodiments, hinged sheaths as shown in FIGS. 10A and 10B may be used. As shown in FIGS. 10A and 10B, hinges of the adjustable couplings are aligned so as to rotate about a common axis, such that a vertical mast can be connected in a horizontal orientation (e.g., at ground level) and then raised via rotation. A rear coupling may match to a rear vertical post, and secure the rear vertical post via a bracket, once vertical mast 304 is raised. The coupling elements direct the tower support loads directly into the structure of the base and transmit all loads to the lower stays. The lower kingpost stays (e.g., comprised of chain in this embodiment) 904*a*, 904*b*, 904*c* provide stability to the base and transmit loads directly to the ballast.

Figure 10C:
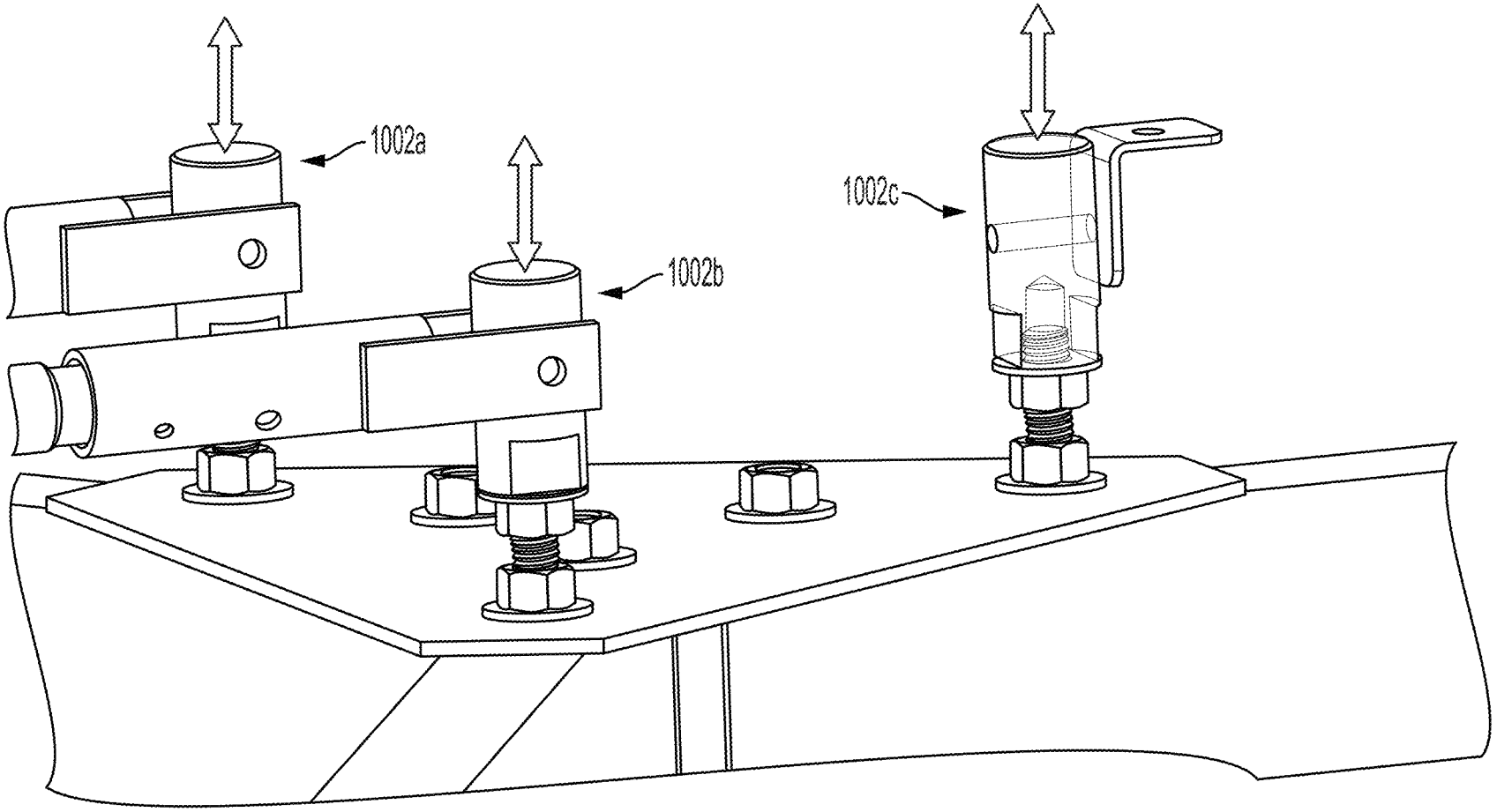
FIG. 10C is a schematic illustrating how an open frame tower may be mounted to a base plate via adjustable couplings, according to an illustrative embodiment.

Turning to FIG. 10C, in certain embodiments a height of each of coupling can be adjusted independently. This design allows for leveling of vertical mast 304 without a need for a separate leveling plate. In particular, unlike the design and approaches described herein, conventional tower designs, such as the ARE tower shown in FIG. 2A-2C require a separate leveling plate (shown as 280 in FIG. 2C), which can be tilted with respect to a lower plate. In contrast, tower technologies of the present disclosure take advantage of the open frame, truss structure used as a vertical mast and its multiple, spaced apart points of contact. By directly varying heights of adjustable couplings that act as support such vertical masts (e.g., at points on vertices of a polygonal cross-section) the approach described herein eliminates the leveling plate of conventional tower designs. Among other things, this approach consequently reduces and/or eliminates stress placed on structural elements due to the separate leveling plate (e.g., which may be subject to torsion).

Moreover, heights of the adjustable couplings can be varied, to create a level surface, before a tower is raised, further facilitating tower deployment. This reduces the cost and weight of the overall solution.

G. Example Approaches for Raising a Tower

Figure 11:
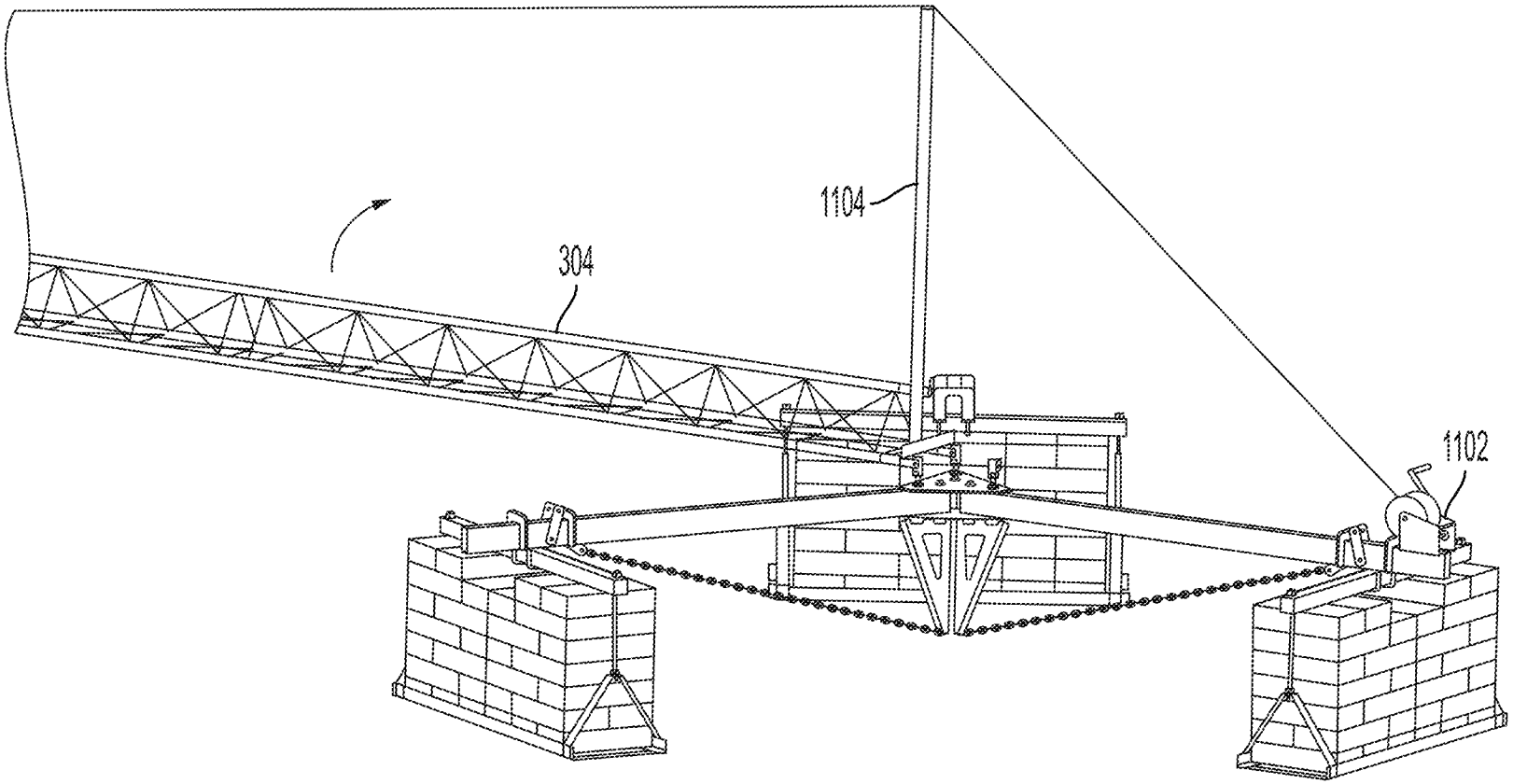
FIG. 11 is a schematic illustrating how a tower may be raised using a winch and gin pole, according to an illustrative embodiment.

Turning to FIG. 11, among other things, by enhancing structural stiffness via design elements as described herein, lightweight vertical masts, such as aluminum tower sections can be used instead of, e.g., heavy steel structures. Use of reduced weight components, among other things, facilitates tower installation. In particular, whereas a conventional ARE tower as shown in FIGS. 2A-2C, which does not benefit from structural enhancements described herein, utilizes a heavy steel vertical mast, which requires a 3 ton to 10 ton hydraulic jack to push the tower up from a horizontal position, in order for it to be raised. In contrast, as shown in FIG. 11, tower systems as described herein, by virtue of their lighter weight, can be raised using a hand winch 1102 (e.g., situated at a distal end of a leg, above a ballast location) and gin pole 1104 (e.g., connected to vertical mast 304). The winch can be turned via hand, so as to pull the tower up using the gin pole.

H. Example Applications

In certain embodiments, relocatable towers as described herein can be used to mount imaging devices for surveying sites. Certain features and advantages of tower designs described herein are of particular relevance to applications such as detection and imaging of volatile compounds, such as hydrocarbon gas. In particular, example hydrocarbon gas imaging sensors are described in PCT Applications: PCT/US17/33157, filed May 17, 2017 (published as WO 2017/201194), PCT/US18/22943 (filed Mar. 16, 2018, published as WO2018/170438), PCT/US18/50760, filed Sep. 12, 2018 (published as WO2019/099096), and PCT/US20/14990, filed Jan. 24, 2020 (published as WO2020/154619), the content of each of which are hereby incorporated by reference in their entirety. Various embodiments of such sensors can be mounted at and/or near a top of vertical masts using relocatable tower technology as described herein and positioned about sites of interest, such as oil and gas production sites, compressors stations, tank storage, gas plants, oil refineries, liquid natural gas storage tanks, landfills, etc. to monitor for gas emissions.

Among other things, in certain embodiments, the capability of relocatable tower technologies described herein to provide high stiffness without a need for ground penetration is particularly important and uniquely suited to addressing shortcomings of conventional tower designs with respect to imaging applications in sensitive areas. In particular, conventional towers used, for example, for applications such as cellular and radio signal transmission (e.g., antenna mounts), are designed primarily for survivability, and allow for flexing and motion of vertical masts, which is of little consequence for interactions involving cellular or radio frequency signals. In contrast, in imaging applications, where a particular area of a site is monitored, such motion causes shifts a field of view of an imaging sensor, rendering portions of the image useless. This is of particular importance if the image is collected over time by combining individual pixels via a scanning system, as opposed to by a snapshot with a full focal plane of image pixels. For example, as described in WO2019/099096, in certain embodiments an imaging sensor may comprise a scanning mechanisms for scanning a sensor instantaneous field of view (ifov) and/or an illumination source (e.g., collectively) over a target region of interest, thereby allowing for an image to be built up as a sensor is scanned. Accordingly, in certain embodiments, particular tower design elements described herein that enhance stiffness and minimize motion (e.g., swaying) at a top of vertical masts on which imaging sensors are mounted meet technical challenges and provide unique functionality targeted to, and of particular relevance for, use in connection with imaging applications.

J. Additional Example Tower Embodiment—Jersey Barrier

Figure 12:
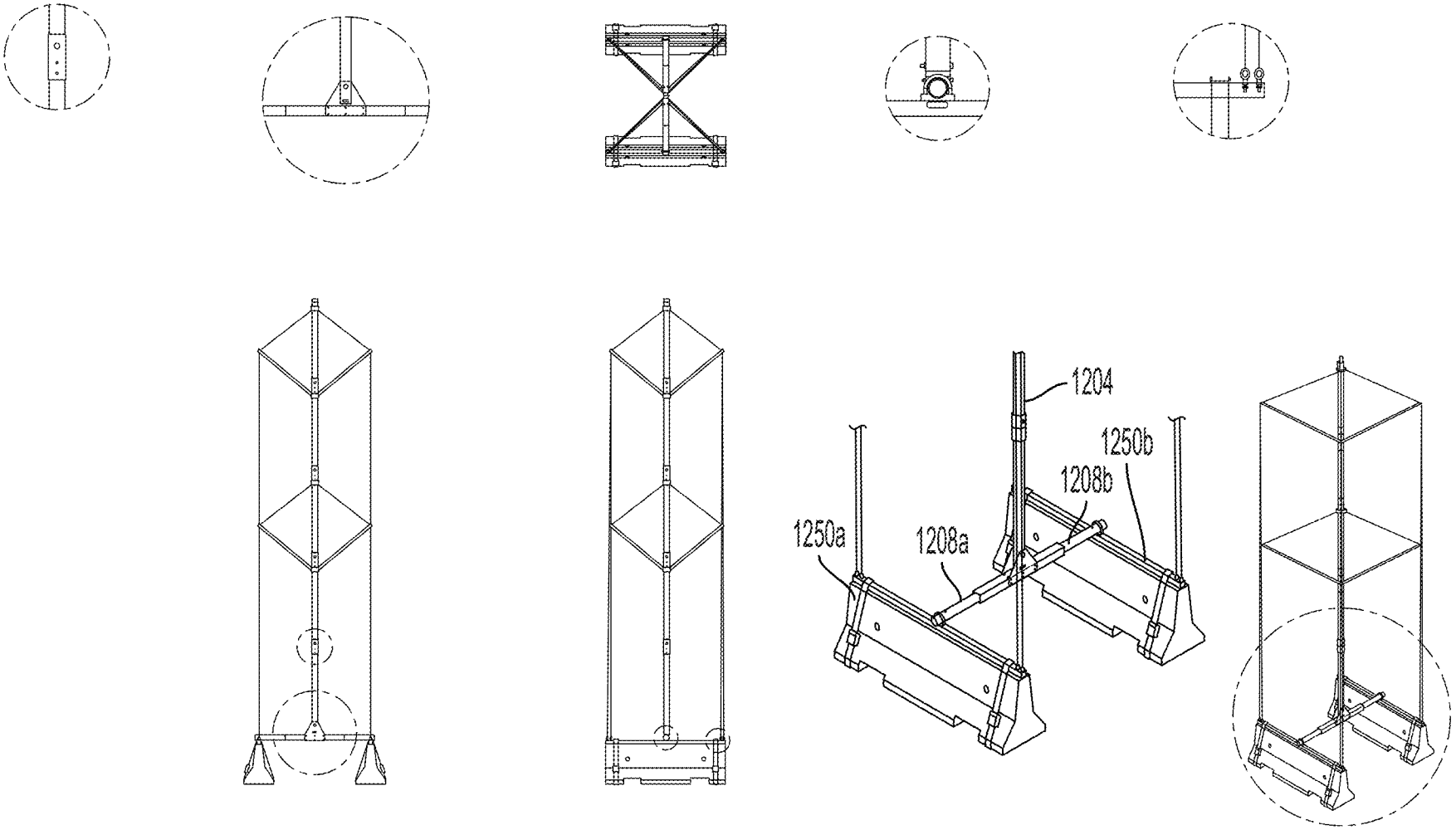
FIG. 12 is a schematic illustrating an example tower using Jersey barriers as ballast, according to an illustrative embodiment.
Figure 13B:
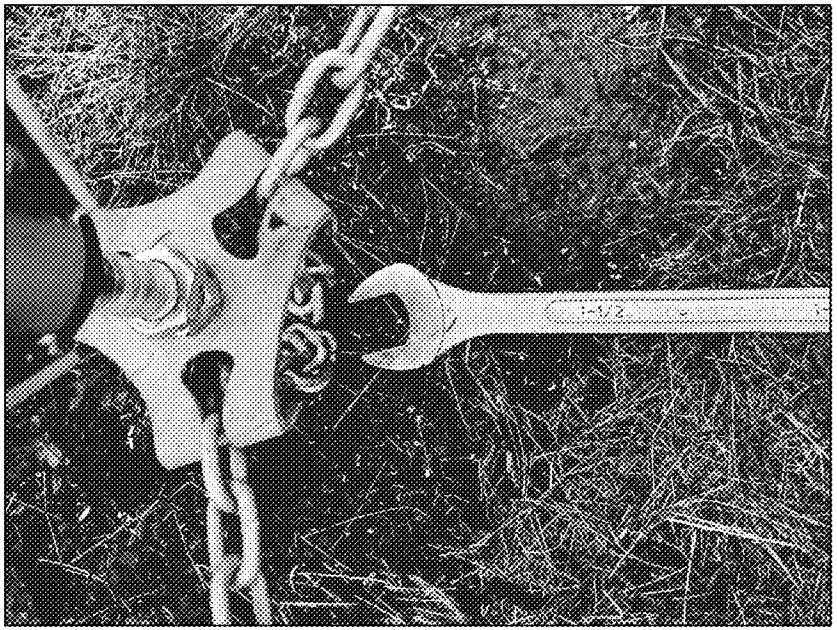
FIG. 13B is a photograph of a clip mechanism for connecting kingpost stays, according to an illustrative embodiment.
Figure 13A:
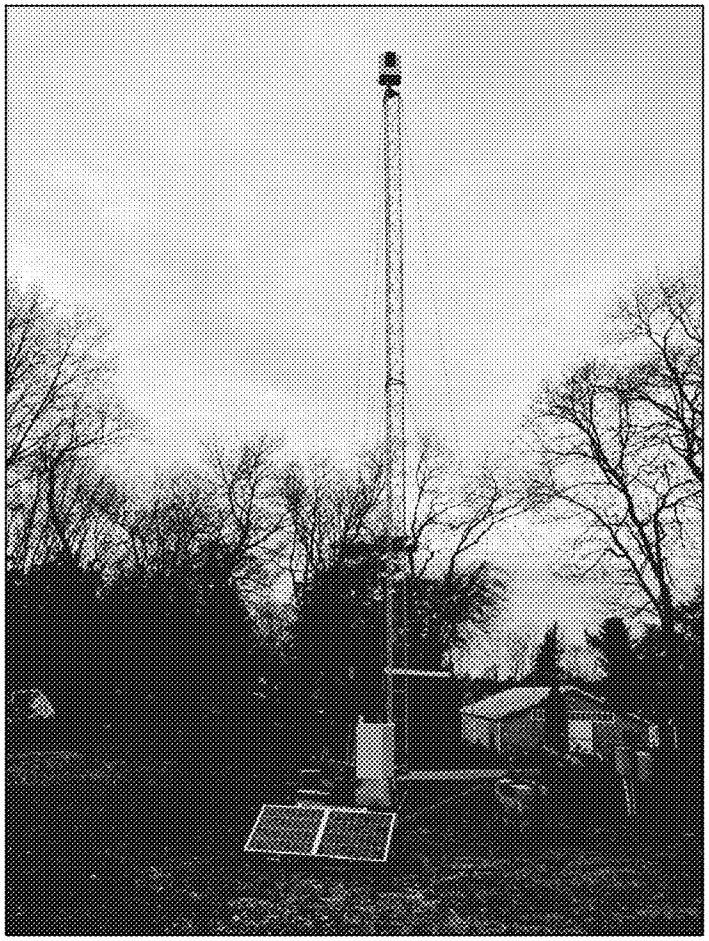
FIG. 13A is a photograph of an open frame, stayed tower according to an illustrative embodiment.
Figure 13D:
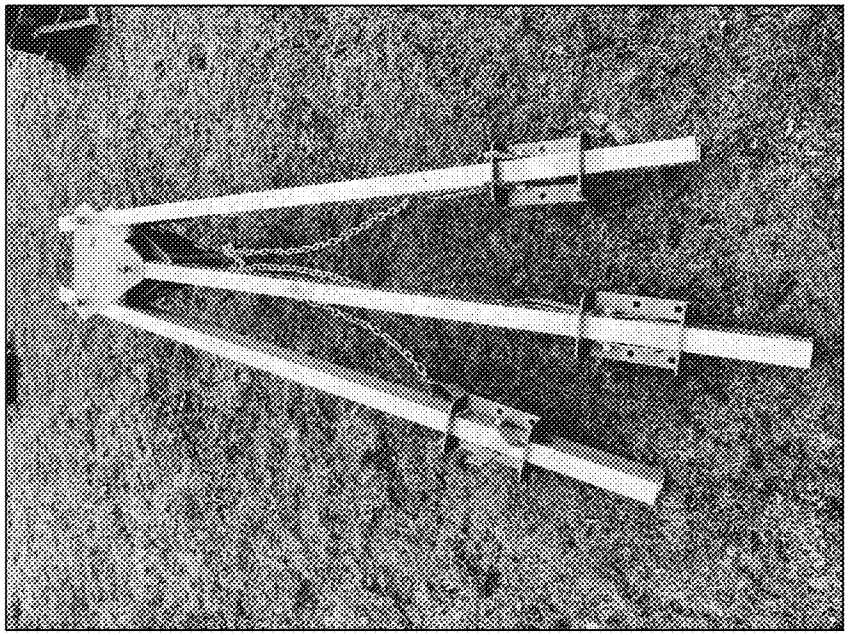
FIG. 13D is a photograph showing a foldable tower base in a folded orientation, according to an illustrative embodiment.
Figure 13C:
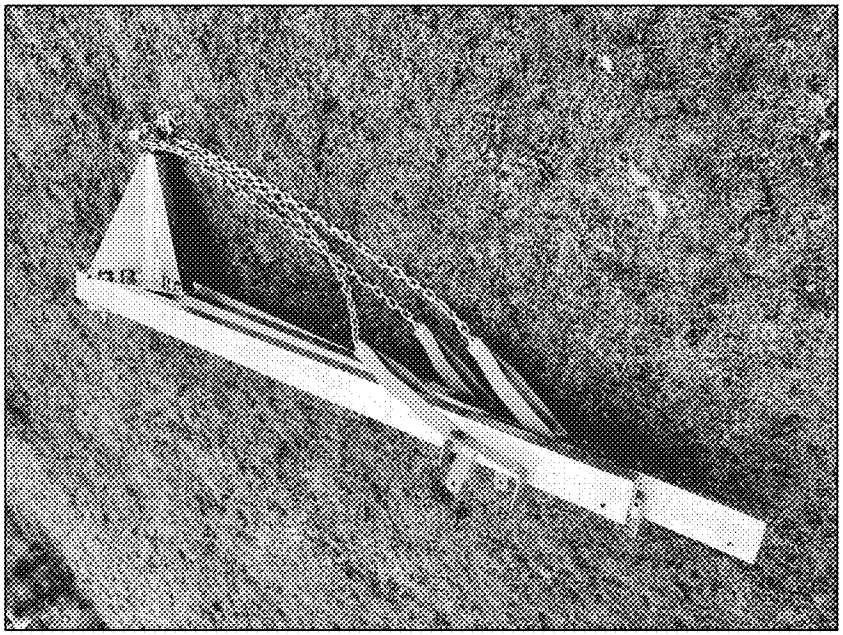
FIG. 13C is a photograph showing a foldable tower base in a folded orientation, according to an illustrative embodiment.

FIG. 12 shows another example tower system, in accordance with various aspects and embodiments described herein. In the example embodiments shown in FIG. 12, a single vertical pole 1204 is connected by two legs 1208*a* and 1208*b* to two parallel Jersey barriers 1205*a* and 1250*b*. As shown in FIG. 12, tower systems need not necessarily incorporate all features described herein simultaneously, but may make use of particular features, such as ballast adaptors that provide for among other things, flexible coupling to ballast.

K. Example Tower Installation and Re-Deployment

FIGS. 13A-D show an example tower in accordance with certain embodiments and aspects described herein. As shown in, for example, FIGS. 13C and D, the example, in certain embodiments one more legs can be connected to the base plate in manner that allows them to rotate, such that they folded up after (e.g., partial) assembly, facilitating fast re-deployment in the field. For example, each leg can be affixed to a common base plate via a single connection point (e.g., bolt), thereby allowing for rotation about the connection point.

Figure 14:
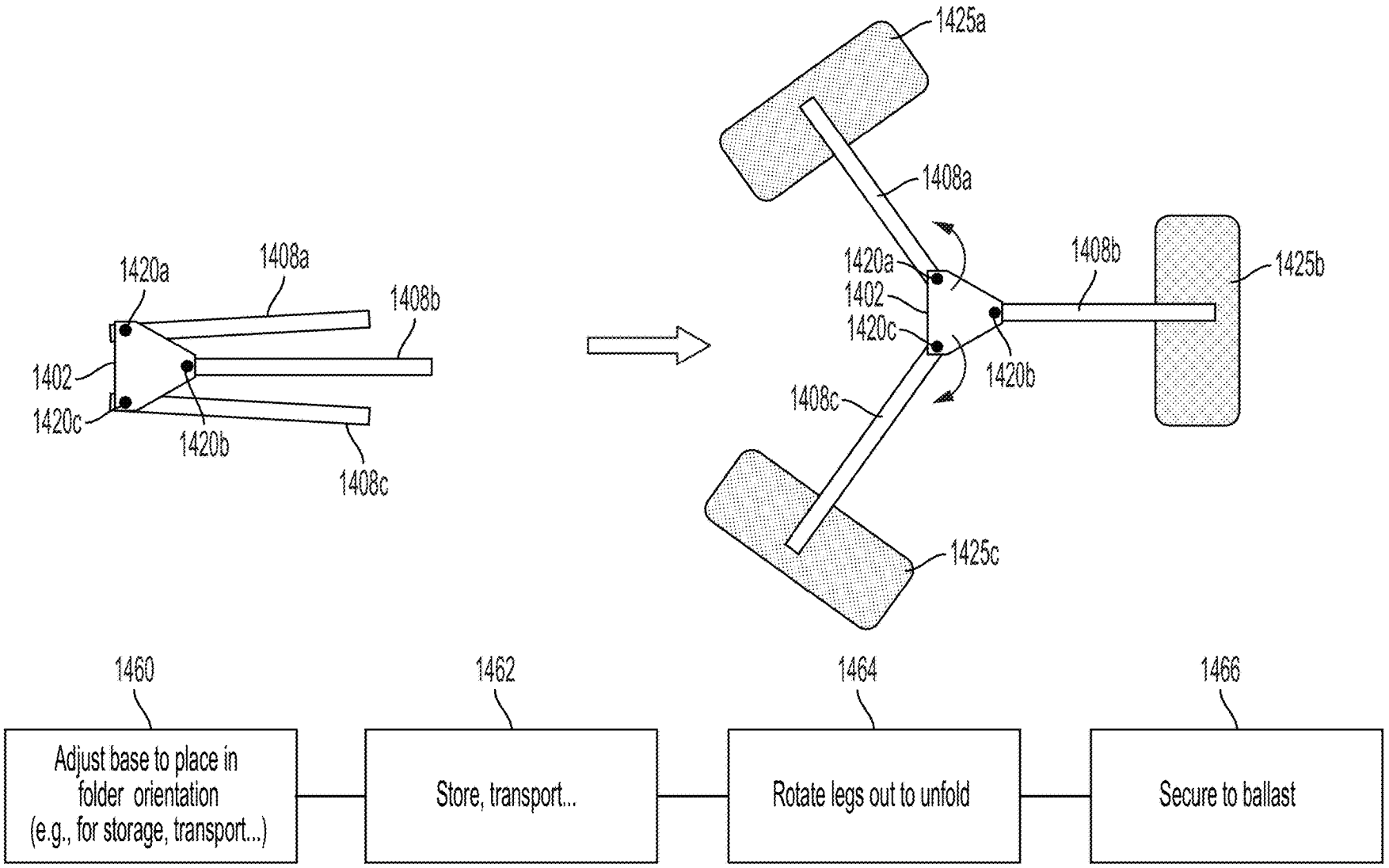
FIG. 14 is a schematic and block flow diagram of a process for folding and unfolding a tower base, according to an illustrative embodiment.

Turning to FIG. 14, in an example re-deployment process, a foldable tower base is adjusted by rotating each of at least a portion of the legs 1408*a*, 1408*b*, 1408*c* about their corresponding connection points 1420*a*, 1420*b*, 1420*c*, so as to position them in a folded orientation, in which each leg 1420*a*, 1420*b*, 1420*c* points in a substantially same direction (while still connected to common base plate 1402). FIG. 14 shows a tower base with a common base plate and three legs connected thereto, such that two out of the three legs are rotated to place it in a folded orientation (1460). Thereafter, the foldable base may be stored and/or transported (1462) to a new location, and then readily re-deployed by rotating legs outwards to unfold them (1464) about common base plate 1402. Once unfolded, legs 1408*a*, 1408*b*, 1408*c* may be secured to ballast 1425*a*, 1425*b*, 1245*c* as described herein (1466).

Throughout the description, where apparatus and systems are described as having, including, or comprising specific components, or where processes and methods are described as having, including, or comprising specific steps, it is contemplated that, additionally, there are apparatus, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A relocatable and ballast-agnostic tower base for providing a foundation to raise and support a vertical mast, the tower base comprising:

a base plate for connecting to the vertical mast;

a plurality of legs, each leg of the plurality of legs connected to and extending outward from the base plate, toward a corresponding ballast location; and a plurality of ballast adaptors, each particular ballast adaptor of the plurality of ballast adaptors (i) associated with and connected to a particular leg of the plurality of legs at the corresponding ballast location and (ii) securable to a ballast weight, wherein each particular ballast adaptor of the plurality of ballast adaptors comprises:

a ballast rail connectable to a ballast weight;

a ballast mount; and a leg mount, wherein:

the ballast mount is secured to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail of the particular ballast adaptor to the particular leg with which it is associated, with the ballast rail aligned along the first axis and the particular leg aligned along the second axis.

2. The tower base of claim 1, wherein the base plate is shaped to engage the vertical mast, wherein the vertical mast has a polygonal cross section.

3. The tower base of claim 1, wherein the plurality of legs comprises three or more legs.

4. The tower base of claim 1, wherein each of at least a portion of the plurality of legs connects to the base plate in a rotatable fashion.

5. The tower base of claim 1, wherein each particular ballast adaptor of the plurality of ballast adaptors is securable to a top of the ballast weight.

6. The tower base of claim 1, wherein each particular ballast adaptor of the plurality of ballast adaptors orients the particular leg to which it is connected above the ballast weight.

7. The tower base of claim 1, wherein the first axis is substantially perpendicular to the second axis.

8. The tower base of claim 1, wherein, for each particular ballast adaptor of the plurality of ballast adaptors, the ballast mount of the particular ballast adaptor is situated below the leg mount of the particular ballast adaptor, such that the particular leg, to which the particular ballast adaptor is connected, is located above the ballast rail of the particular ballast adaptor.

9. The tower base of claim 1, wherein:

a cross section of the first passage of the ballast mount is sufficiently sized to allow the ballast mount to be translated along at least a portion of a length of the ballast rail; and a cross section of the second passage of the leg mount is sufficiently sized to allow the leg mount to be translated along at least a portion of a length of the particular leg.

10. The tower base of claim 1, wherein:

the ballast mount comprises two or more U-hooks and is secured to the leg mount by connecting the two or more U-hooks with a lower surface of the leg mount.

11. The tower base of claim 1, wherein the leg mount comprises two guides aligned and maintained with respect to each other in a spaced relationship.

12. The tower base of claim 1, comprising:

a kingpost affixed to an underside of the plurality of legs at a central point and extending downward; and for each particular leg of the plurality of legs, a corresponding kingpost stay connecting (i) the particular leg and/or associated ballast adaptor at the corresponding ballast location to (ii) a substantially common central point at an apex of the kingpost.

13. The tower base of claim 12, wherein for each particular leg of the plurality of legs, the corresponding kingpost stay connects to the particular leg and/or associated ballast adaptor at a guy wire connection point.

14. The tower base of claim 1, wherein the base plate comprises a plurality of adjustable couplings, each particular adjustable coupling of the plurality of adjustable couplings matched to a vertical post of the vertical mast and comprising an upper surface for supporting the vertical post to which the particular adjustable coupling is matched.

15. The tower base of claim 14, wherein heights of the plurality of adjustable couplings are independently adjustable.

16. The tower base of claim 14, wherein a subset of the plurality of adjustable couplings comprises hinged connectors into which their matching vertical posts can be inserted, wherein the hinged connectors are rotatable about a common axis such that a vertical mast connected to the subset of the plurality of adjustable couplings via the hinged connectors can be rotated from a substantially horizontal position to a vertical orientation.

17. The tower base of claim 1, further comprising a gin pole and/or a hand winch for raising and/or lowering the vertical mast.

18. The tower base of claim 5, wherein one or more spacers are disposed between the ballast rail and the ballast weight.

19. A relocatable tower system comprising:

a vertical mast comprising a plurality of vertical poles and a plurality of braces connecting each pole with an adjacent pole at a plurality of locations; and a relocatable and ballast-agnostic tower base comprising:

a base plate for connecting to the vertical mast;

a plurality of legs, each leg of the plurality of legs connected to and extending outward from the base plate, toward a corresponding ballast location; and a plurality of ballast adaptors, each particular ballast adaptor of the plurality of ballast adaptors (i) associated with and connected to a particular leg of the plurality of legs at the corresponding ballast location and (ii) securable to a ballast weight, wherein each particular ballast adaptor of the plurality of ballast adaptors comprises:

a ballast rail connectable to ballast weight;

a ballast mount; and a leg mount, wherein:

the ballast mount is secured to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail of the particular ballast adaptor to the particular leg with which it is associated, with the ballast rail aligned along the first axis and the particular leg aligned along the second axis.

20. The relocatable tower system of claim 19, wherein the vertical mast does not have a solid outer wall.

21. The relocatable tower system of claim 19, wherein the base plate of the tower base is shaped to engage the vertical mast, wherein the vertical mast has a polygonal cross section.

22. The relocatable tower system of claim 19, wherein:

a cross section of the first passage of the ballast mount is sufficiently sized to allow the ballast mount to be translated along at least a portion of a length of the ballast rail; and a cross section of the second passage of the leg mount is sufficiently sized to allow the leg mount to be translated along at least a portion of a length of the leg.

23. The relocatable tower system of claim 19, comprising an imaging sensor mounted at a top of the vertical mast.

24. A method of deploying a tower system comprising a vertical mast and a tower base comprising a plurality of legs, the method comprising:

securing a tower base to a plurality of pre-existing ballast weights, each of the pre-existing ballast weights located at a particular ballast location, by:

connecting, for each particular ballast location, a first end of a corresponding one of the plurality of legs of the tower base to a top of the pre-existing ballast weight via an associated ballast adaptor; and connecting each of the legs to a common base plate of the tower base at a substantially central location with respect to the ballast locations, wherein, for each particular pre-existing ballast weight located at the particular ballast location, the associated ballast adaptor is (i) connected to the first end of the corresponding leg and (ii) securable to the particular pre-existing ballast weight, and wherein each ballast adaptor comprises:

a ballast rail connectable to ballast weight;

a ballast mount; and a leg mount, wherein:

the ballast mount is secured to the leg mount and comprises a first passage oriented along a first axis, through which the ballast rail passes, and the leg mount comprises a second passage oriented along a second axis, through which the particular leg with which the particular ballast adaptor is associated passes, thereby securing the ballast rail of the particular ballast adaptor to the particular leg with which it is associated, with the ballast rail aligned along the first axis and the particular leg aligned along the second axis.

25. The method of claim 24, comprising deploying the tower system without substantially penetrating a ground upon which the tower system is located.

26. The method of claim 24, wherein none of: (i) the tower base, (ii) the plurality of ballast weights, and (iii) the vertical mast are located at least in part beneath ground level.

27. The method of claim 24, comprising deploying the tower system without using heavy machinery.

28. A method of re-deploying a tower system comprising a foldable base, the method comprising:

(a) adjusting the foldable base to position a plurality of legs thereof in a folded orientation, wherein:

the foldable base comprises the plurality of legs and a common base plate, each of the plurality of legs is connected to the common base plate at a corresponding connection point about the perimeter of the common base plate, each of at least a portion of the plurality of legs is rotatable in a plane substantially parallel to the common base plate, about its corresponding connection point, and when in the folded orientation, each of the plurality of legs are aligned pointing in a substantially same direction; and (b) adjusting the foldable base to position the plurality of legs thereof in an un-folded orientation by rotating each of one or more of the plurality of legs about their corresponding common connection points, such that the plurality of legs point outwards from the common base plate.

* * * * *